United States Patent [19]

Nishimura et al.

[11] 3,935,016

[45] Jan. 27, 1976

[54] SILVER HALIDE COLOR PHOTOGRAPHIC MATERIALS CONTAINING 3-ANILINO-5-PYRAZOLONE COUPLERS

[75] Inventors: Tokio Nishimura; Minoru Yamada; Hiroyuki Amano; Yasushi Oishi, all of Minami-ashigara, Japan

[73] Assignee: Fuji Photo Film Company, Ltd., Minami-ashigara, Japan

[22] Filed: Apr. 15, 1974

[21] Appl. No.: 461,086

[30] Foreign Application Priority Data

Apr. 13, 1973 Japan ..... 48-41868

[52] U.S. Cl. ..... 96/74; 96/56; 96/95; 96/100

[51] Int. Cl.[2] ..... G03C 1/76; G03C 1/40

[58] Field of Search ..... 96/56, 95, 100, 74

[56] References Cited

UNITED STATES PATENTS

| | | | |
|---|---|---|---|
| 3,127,269 | 3/1964 | Greenhalgh et al. | 96/100 |
| 3,761,274 | 9/1973 | Inoue et al. | 96/100 |
| 3,764,337 | 10/1973 | Arai et al. | 96/56 |

*Primary Examiner*—J. Travis Brown

*Attorney, Agent, or Firm*—Sughrue, Rothwell, Mion, Zinn & Macpeak

[57] ABSTRACT

A color photographic material comprising a support having coated thereon at least one silver halide emulsion layer containing a magenta dye forming coupler having a 3-anilino-5-pyrazolone ring in which the ortho position of the anilino group at the 3-position is substituted with a halogen atom, an alkyl group, an alkoxy group, an amide group, an aryl group, an aryloxy group, a cyano group, a nitro group, a hydroxyl group, or an amino group and having a hydrophobic residue of 8 to 32 carbon atoms, the silver halide emulsion layer or an emulsion layer adjacent to the silver halide emulsion layer containing a hydroquinone derivative having at least one substituent of at least 8 carbon atoms or a precursor capable of providing such a hydroquinone derivative by hydrolysis.

The color photographic material provides magenta dye images having good color separation and less color fog and less color stains in the highlight areas.

18 Claims, No Drawings

SILVER HALIDE COLOR PHOTOGRAPHIC MATERIALS CONTAINING 3-ANILINO-5-PYRAZOLONE COUPLERS

BACKGROUND OF THE INVENTION

1. Field of the Invention

This invention relates to color photography and, more particularly, it relates to a light-sensitive color photographic material wherein color fog and stains are effectively prevented and color images of good color separation are obtainable.

2. Description of the Prior Art

For the formation of color photographic images based on a subtractive color process, the steps of forming cyan, magenta, and yellow dye images by the coupling of dye-forming couplers with the oxidation product of generally an aromatic primary amine compound, and in particular a N,N-di-substituted p-phenylenediamine compound, developing agent formed by reducing the exposed silver halide grains in photographic emulsion layers are utilized.

The couplers used for the color development are compounds which have a phenolic hydroxyl group, an anilinic amino group, or an active methylene group and form dyes capable of absorbing light in a visible wavelength region by the oxidative coupling with the aromatic primary amine developing agent.

As the magneta-forming couplers, pyrazolones are generally known. Of the pyrazolone couplers, the 3-anilino-5-pyrazolone compounds have long been known as good magenta-forming couplers in the field of color photography as described in, for instance, the specification of U.S. Pat. No. 2,311,081 (Reissue 22,329) and also, in British Pat. No. 956,261, an azomethine dye obtained from a 3-anilino-5-pyrazolone derivative substituted with an alkoxyl group or a halogen atom in the ortho-position of the anilino group is described as having a useful spectral absorption for color photography and also the description is that the unnecessary absorption in the red light region is particularly less. Non-diffusible couplers which belong to this type of coupler and can be incorporated in photographic emulsions are described in the specifications of U.S. Pat. Nos. 3,127,269, 3,658,544, 2,684,516, 3,419,391 and 3,519,429, and Japanese patent application Nos. 114,446/1972, 114,445/1972, and 21454/1973 and German OLS 2,133,655. Of these 3-anilino-5pyrazolone couplers, the couplers in which the ortho-position of the anilino group at the 3-position has been substituted with a halogen atom, an alkyl group, an alkoxyl group, a nitro group, a cyano group, a hydroxyl group, or an amide group and which has at least one hydrophobic residue having 8 to 32 carbon atoms are most excellent at present in that the couplers provide color images having sharp spectral absorption curve and less unnecessary absorption in the red region and the blue region and that the couplers show excellent coupling or coloring at color development. However, in spite these excellent advantages as shown above, magenta dye-forming couplers of this type do not provide satisfactory color photographic materials using conventional techniques for the following reasons. That is to say, the couplers suffer from severe magenta fogging at color development of the color photographic materials containing the magenta dye-forming couplers, yellow stains are readily formed in the color photographic materials containing the magenta dye-forming couplers with the passage of time after processing due to the action of the formaldehyde used in the hardening or the dye image stabilization during color processing, color mixing occurs greatly between the photosensitive emulsion layer containing the magenta dye-forming coupler and other photosensitive emulsion layers, and further the magenta dye-forming couplers tend to be oxidized during the addition of the couplers to photographic emulsions in the production of color photographic materials.

The development of a technique for using these substituted 3-anilino-5-pyrazolone couplers as described above in color photographic materials unaccompanied by the above-described disadvantages has, thus, been desired.

SUMMARY OF THE INVENTION

A first object of this invention is, therefore, to provide a color photographic material which provides a magenta dye image having less color fog and a high image coupling density at color development.

A second object of this invention is to provide a color photographic material which provides color reproduction with good color separation.

A third object of this invention is to provide a color photographic material which provides a color image having excellent spectral absorption characteristics, showing particularly sharp red color reproduction, and having good color separation.

A fourth object of this invention is to provide a color photographic material which provides a magenta dye image capable of being stored stably even in the presence of light.

A fifth object of this invention is to provide a color photographic material which can be processed using quick color development.

A sixth object of this invention is to provide a color photographic material which is stable when produced.

It has been discovered that the above-described objects of this invention can be surprisingly attained by incorporating a hydroquinone having at least one substituent of at least 8 carbon atoms on the hydroquinone nucleus or aa preccusor capable of providing such a hydroquinone on hydrolysis in at least one of a silver halide emulsion layer containing a magenta dye-forming coupler having a 3-anilino-5-pyrazolone ring, in which the ortho-position of the anilino group at the 3position is substituted with a halogen atom, an alkyl group, an alkoxyl group, an amide group, an aryl group, an aryloxy group, a cyano group, a nitro group, a hydroxyl group, or an amino group, and having at least one hydrophobic group of 8 to 32 carbon atoms or in a hydrophilic colloid layer adjacent the silver halide emulsion layer.

Therefore, the present invention provides a color photographic material comprising a support having coated thereon a silver halide emulsion layer containing a magenta dye-forming coupler having a 3-anilino-5-pyrazolone ring, the orthoposition of the anilino group at the 3-position being substituted with a halogen atom, an alkyl group, an alkoxyl group, an amide group, an aryl group, an aryloxy group, a cyano group, a nitro group, a hydroxyl group, or an amino group, and having at least one hydrophobic group of 8 to 32 carbon atoms, and at least one of the silver halide emulsion layer and a hydrophilic colloid adjacent to the silver halide emulsion layer containing therein a hydroquinone having at least one substituent of at least 8 carbon atoms on the hydroquinone nucleus or a precursor capable of providing the hydroquinone on hydrolysis.

DETAILED DESCRIPTION OF THE INVENTION

The magenta dye-forming couplers which can be used in this invention can be represented by general formula (I)

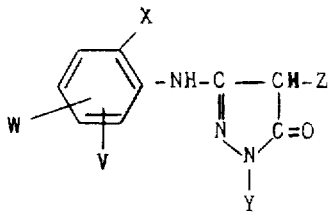

(I)

wherein X represents a straight chain or branched alkyl group having 1 to 12 carbon atoms, such as a methyl group, a t-butyl group, and an octyl group; an alkoxyl group (including an alkylthio group) such as a methoxy group and an octylthio group; and aryl group such as a phenyl group; an aryloxy group such as a phenoxy group and a p-t-butylphenoxy group; an amino group such as a methylamino group, a diethylamino group, and an anilino group; an amide group such as an acetamido group, a butylamido group, a methylsulfonamido group, and a diacylamido group; a halogen atom such as a fluorine atom, a chlorine atom, and a bromine atom; a hydroxyl group; a cyano group; or a nitro group; Y represents an aryl group such as a phenyl group, a 2-chlorophenyl group, a 4-chlorophenyl group, a 2,5-dichlorophenyl group, a 2,6dichlorophenyl group, a 2,4,6-trichlorophenyl group, a 2-bromophenyl group, a 3,5-dibromophenyl group, a 2-cyanophenyl group, a 4cyanophenyl group, a 3-nitrophenyl group, a 4-nitrophenyl group, a 4 -methylphenyl group, a 2,6-dimethylphenyl group, a 2,6-diethylphenyl group, a 4-butylphenyl group, a 2-trifluoromethylphenyl group, a 2-chloro-5-nitrophenyl group, a 2-chloro-5-cyanophenyl group, a 5-chloro-2methylphenyl group, a 2,6-dichloro-4-methylphenyl group, a 2,4-dichloro-6-methylphenyl group, a 2-chloro-4,6-dimethylphenyl group, a 2,6-dichloro-4-methoxyphenyl group, a 2,6-dichloro-4-nitrophenyl group, a 2,4,6-trimethyl-3-nitrophenyl group, a 2,4,6-trimethyl-3-substituted aminophenyl group, etc.; a heterocyclic group such as a 5- or 6-membered heterocyclic group, e.g., a 2-thiazolyl group, a 2-benzothiazolyl group, a 2-benzoxazolyl group, a 2-oxazolyl group, a 2-imidazolyl group, and a 2-benzimidazolyl group; Z represents a hydrogen atom or a group which can be released by the coupling reaction with an oxidized aromatic primary amine color developing agent, e.g., a thiamino group; and acyloxy group such as an acetoxy group, a dodecanoyloxy group, an octadecanoyloxy group, a 3-pentadecylphenoxyacetoxy group, a benzoyloxy group, a $\beta$-naphthoyloxy group, and 3-[$\gamma$-(2,4-di-t-amylphenoxy)-butylamido] benzoyloxy group; an aryloxy group such as a phenoxy group, a p-chlorophenoxy group, a p-nitrophenoxy group, and a naphthoxy group; an aralkyloxycarbonyloxy group such as a benzyloxy group and a carbonyloxy group; an alkyloxycarbonyloxy group such as an ethyl oxycarbonyloxy group; a halogen atom such as a bromine atom, a chlorine atom, and a fluorine atom; an arylazo group such as a substituted or unsubstituted phenylazo group and a naphthylazo group; a 2-aryltriazolyl group such as a 2-benzotriazolyl group and a 2-naphthotriazolyl group; an alkylthio group such as an alkylthio group having 4 to 10 carbon atoms; an arylthio group such as a phenylthio group and a naphthylthio group; a heterothio group such as a 2-benzothiazolylthio group, a 1-phenyl-5-tetrazolylthio group, a 2-benzoxazolylthio group, a 2-benzimidazolylthio group, a 5-phenyl-1,3,4-oxadiazolyl-2-thio group, etc,; a cycloalkylthio group such as a cyclohexylthio group; and a cycloalkoxyl group such as a cyclohexyloxy group; W represents a group containing a hydrophobic residue having 8 to 32 carbon atoms, the hydrophobic residue being connected to the anilino nucleus directly or through a carbonamido bond, a carbonimido bond, a carbamoyl bond, a sulfonamido bond, a sulfamoyl group, a carboxylic acid ester bond, a urea bond, a sulfonyl group, a carbonyl group, an ether group, an amino bond, an imido bond, a thioether bond, etc.; and V represents a hydrogen atom or a group selected from the groups defined by X and W, the group V being the same as or different from X or W.

Typical examples of suitable hydrophobic groups are as follows:

1. Alkyl groups and alkenyl groups such as

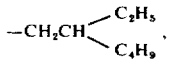

$-C_{12}H_{25}$, $-C_{16}H_{33}$, $-C_{17}H_{33}$,

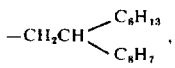

and $-C_{18}H_{35}$.

2. Alkoxyalkyl groups such as $-(CH_2)_3O(CH_2)_7CH_3$ and

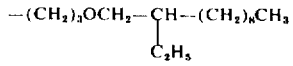

3. Alkylaryl groups such as

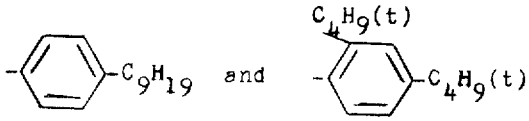

4. Alkyloxycarbonylalkyl groups such as $-CH_2CH_2OOOC_{12}H_{25}$ and couplers

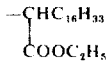

5. Alkylaryloxyalkyl groups such as

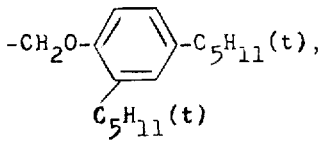

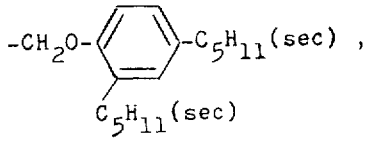

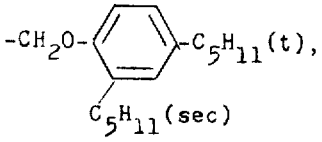

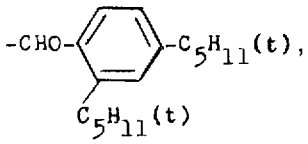

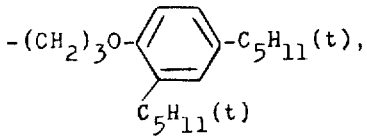

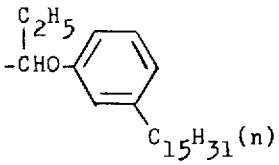

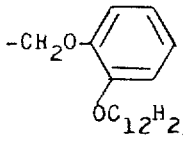

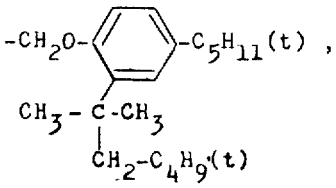

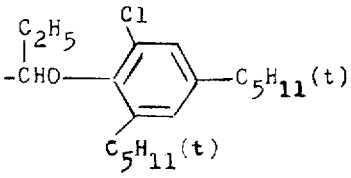

6. Acylamidoalkyl groups such as

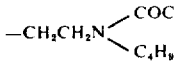

$-CH_2CH_2NHCOC_{12}H_{25}$,

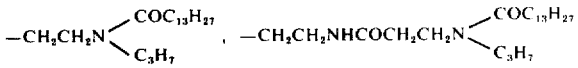

7. Alkoxyaryl groups and alkaryloxyaryl groups such as

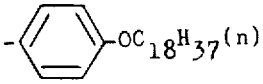

and

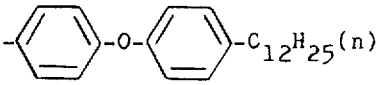

8. Residues having an alkyl or alkenyl long chain aliphatic group together with a carboxyl or sulfo water-solubilizing group such as

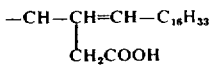

and

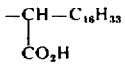

Furthermore, the bispyrazolone derivatives formed through group V, W, Y or Z, e.g., bonded through groups of V, W, Y and E, are included in this invention.

Suitable examples of anilino type magenta dye-forming couplers are disclosed in U.S. Pat. NOs. 3,419,391, 3,519,429, 3,432,300, 3,127,269, 3,658,544, 3,684,514, and 3,698,909.

The hydroquinones which can be used in this invention can be represented by the following general formula (II)

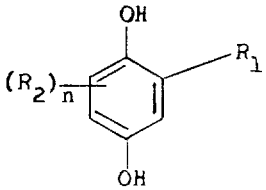

(II)

wherein $R_1$ and $R_2$, which may be the same or different, each represents a straight chain or branched chain substituted or unsubstituted alkyl group having 1 to 18 carbon atoms, in which examples of substituents for the alkyl group are a halogen atom (e.g., fluorine, bromine, chlorine, etc.), a hydroxy group, an alkoxy group (e.g. methoxy, ethoxy, ethoxyethoxy, hexyloxy, dodecyloxy, etc.), an aryloxy group (e.g., phenoxy, p-tert-butyl-phenoxy, etc.), an aryl group (e.g., phenyl, tolyl, p-tridecanamidophenyl, naphthyl etc), an amino group (e.g., ethylamino, dodecylamino, di-ethylamino, N-methyl-N-dodecylamino, anilino, toluidino, phenethylamino, etc.), an acylamino group (e.g., formamido, acetamido, pivaloylamido, lauroylamido, stearoylamido, benzoylamido, etc.), an imide group, a carboxy group, an alkoxycarbonyl group (e.g., ethoxycarbonyl, dodecyloxycarbonyl, etc.), a carbamoyl group (e.g., tert-butylcarbamyl, diethylcarbamyl, isooctylcarbamyl, tolylcarbamyl, etc.) or a sulfonamide group with these substituents being further substituted, e.g., alkyl groups such as a methyl group, a t-butyl group, a t-octyl group, and an octadecyl group; an alkoxyl group having 1 to 18 carbon atoms such as methoxy, ethoxy, octyloxy, dodecyloxy, etc.; an aryl group, e.g., phenyl, tolyl, halophenyl, naphthyl, etc.; an aryloxy group, e.g., phenoxy, tolyloxy, halophenoxy, naphthoxy, etc.; an aralkyl group, e.g., benzyl, phenethyl, etc.; a halogen atom, e.g., fluorine, bromine, iodine, etc.; or a carbamoyl group such as a di-t-butylcarbamoyl group; and n represents 1,2, or 3. The alkyl group and aryl group represented by $R_1$ or $R_2$ can be substituted with a halogen atom, an alkyl group, an aryl group, an aralkyl group, an alkoxyl group, an aryloxy group, a carboxyl group, a carbalkoxyl group, an acyloxy group, a carbamoyl group, an acylaminosulfo group, a sulfonyloxy group, an amido group, an ether group, or a sulfo group.

In the hydroquinone represented by general formula (II), group $R_2$ can be a hydrogen atom but it is required that the sum of the number of carbon atoms of $R_1$ and $R_2$ be at least 8 and suitably up to about 36 carbon atoms.

As described above, the hydroquinone derivatives which can be used in this invention include a precursor of the abovedescribed hydroquinone. The term "precursor" as used in this invention designates a compound capable of releasing the abovedescribed hydroquinone derivative by hydrolysis in an alkaline solution such as a developer. Examples of such a precursor are a hydroquinone derivative as described above in which one or both of the hydroxyl groups of the hydroquinone are acylated groups such as

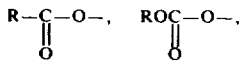

and

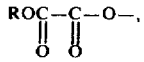

wherein R represents an aliphatic group such as an alkyl group, an alkenyl group, etc., having 1 to 18 carbon atoms.

One of the features of the magenta dye-forming coupler which can be used in this invention is that the hydrophobic group is positioned at the 3-position of anilino nucleus of the pyrazolone. A magenta dye-forming coupler having a hydrophobic group at the 1-position of the pyrazolone nucleus generally has the tendency toward low coupling reactivity and hence is unsatisfactory. Therefore, for the compound shown by general formula (I), in which Y is a phenyl group with at least one of the ortho positions being substituted, in particular the coupler represented by following general formula III is useful;

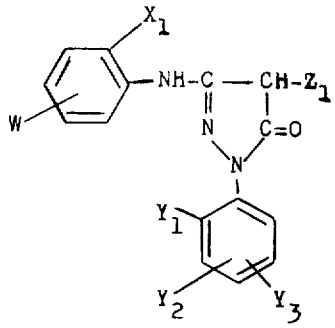

(III)

wherein W has the same meaning as in general formula (I), $Z_1$ represents a hydrogen atom, an aryl azo group, a naphthyl azo group, an alkylthio group or an arylthio group. $X_1$ represents a halogen atom such as a fluorine atom, a chlorine atom, or a bromine atom; an alkoxyl group such as a methoxy group; a nitro group; a cyano group; a hydroxyl group or an alkyl group such as a methyl group, $Y_2$ and $Y_3$ each represents a hydrogen atom; a halogen atom such as a fluorine atom, a chlorine atom, or a bromine atom; an alkyl group; an alkoxyl group; a carboxyl group; a nitro group, am aryloxy group; a cyano group; or an acylamino group, and $Y_1$ is as described for $Y_2$ and $Y_3$ except that $Y_1$ is not a hydrogen atom. It is desirable that at least one of the ortho groups of the phenyl group at the pyrazolone 1-position of the compound represented by general formula (III) is substituted with a halogen atom or a residue such as an alkyl group and an alkoxyl group since in the case of using the 3-anilino-5-pyrazolone coupler having at the 1-position a phenyl group of which both ortho positions are not substituted, the coupler remaines in the color photographic material after color development to cause yellow print out and to stain the color images.

As the substituted phenyl group at the 1-position of the coupler represented by general formula (III), such residues as a 2,4-dichlorophenyl group, a 2,5-dichlorophenyl group, a 2,6-dichlorophenyl group, a 2,4,6-trichlorophenyl group, a 2,5-dibromophenyl group, a 2,4-dibromophenyl group, a 2,6-dichlorophenyl group, a 2,4,6-tribromophenyl group, a 2,4-dichloro-6-methylphenyl group, a 2,6-dichloro-4-methylphenyl group, a 2,4-dichloro-6-methoxyphenyl group, a 2,6-dichloro-4-methoxyphenyl group, a 2-chloro-4-nitrophenyl group, and a 2-chloro-5-nitrophenyl group are particularly preferable in that the occurence of the above-described coloring of the coupler is less and the spectral absorption of the dye image formed has preferred characteristics as a magenta dye image in the subtractive color process, i.e., the absorption maximum is in a range of 530 to 565 millimicrons and the absorption of blue light and red light is less.

The hydroquinone type compounds which can be used in this invention are generally represented by above-described general formula (II) but compounds in which $R_1$ and $R_2$ are a straight chain or branched alkyl group are particularly useful.

These hydroquinone compounds are well known and are described in, for instance, the specifications of U.S. Pat. Nos. 2,336,327; 2,360,290; 2,384,658; 2,403,721; 2,418,613; 2,675,314; 2,701,197; 2,704,713;

2,728,659; 2,732,300; 2,735,765; German Patent Offenlegungsschrift 2,149,789; Japanese patent publication No. 54116/'69 and Japanese patent application Laid Open No. 45628/'72.

The inventors made various experiments for practically using 3-anilino-5-pyrazolone type couplers and as the results thereof it has been discovered that in using 3-anilino-5-pyrazolone type couplers, the application of the conventional formaldehyde treatment is unnecessary. It is also quite interesting that when the formaldehyde treatment is omitted in using other pyrazolone couplers such as, for instance the 3-acylamino-5-pyrazolones as described in the specifications of U.S. Pat. Nos. 2,369,489 and 2,600,788 and the 3-ureido-5-pyrazolone as described in the specification of U.S. Pat. No. 3,558,319, thermal fading or fading in the darkness after processing occurs greatly, which becomes a great disadvantage for color photographic materials containing these couplers in practical use. The aforesaid fact is an important advantage of the 3-anilino-5-pyrazolone type couplers and further it is quite preferred from the problem of pollution that the formaldehyde treatment be omitted from photographic processings.

The use of the 3-anilino-5-pyrazolone type coupler and the hydroquinone type compound according to the present invention can prevent the occurence of color mixing on color development and further can control the formation of fog without substantially reducing the sensitivity of color photographic materials containing these components. The term "color mixing" is a phenomenon which occurs when a so-called multilayer color photographic material, i.e., a color photographic material having coated on a support differently sensitized emulsion layers in a superposed relationship is developed, the oxidation products of a developing agent are interchanged between one photosensitive emulsion layer and another photographic emulsion layer adjacent to the aforesaid emulsion layer, whereby the corresponding relation of sensitivity and coloring is disturbed. That is to say, this term designates the phenomenon that while originally the red-sensitized layer is colored cyan only by red exposure, the green-sensitized emulsion layer magenta only by green exposure, and the blue-sensitized emulsion layer yellow only by blue exposure respectively, the red-sensitized emulsion layer is colored cyan and magenta by red exposure, the green-sensitized emulsion layer is colored magenta and cyan by green exposure, and the blue-sensitized emulsion layer in yellow and magenta by blue exposure. The occurence of this phenomenon reduces the color reproducibility.

Also, a coupler dispersion is usually prepared by dispersing a coupler in a hydrophilic colloid together with a high boiling organic solvent, e.g., having a boiling point greater than 180°C such as tricresylphosphate, dibutylphthalate, dioctylbutylphosphate, acetyltributyl citrate, N,N-di-ethyllaurylamide, etc., and/or a low boiling organic solvent, e.g., having a boiling point lower than 150°C such as ethyl acetate, butyl acetate, etc., and in this case by adding the hydroquinone type compound used in this invention to the coupler dispersion, the oxidation of the coupler used in this invention can be prevented and thus the coupler dispersion can be prepared without problems. Furthermore, when the coupler and the hydroquinone type compound are used together according to this invention, the formation of yellow stains in the color photographic materials containing them can be effectively prevented regardless of the presence or absence of formaldehyde and in such a case, even if a formaldehyde treatment is employed in the color photographic processings, the presence of formaldehyde does not adversely influence the quality of the color images obtained.

Specific examples of the compounds included in the abovedescribed general formulae which can be used in this invention are illustrated below although the compounds of this invention are not limited to these compounds only.

Specific examples of the magenta dye-forming couplers which can be used in this invention are shown below:

(I) - 1

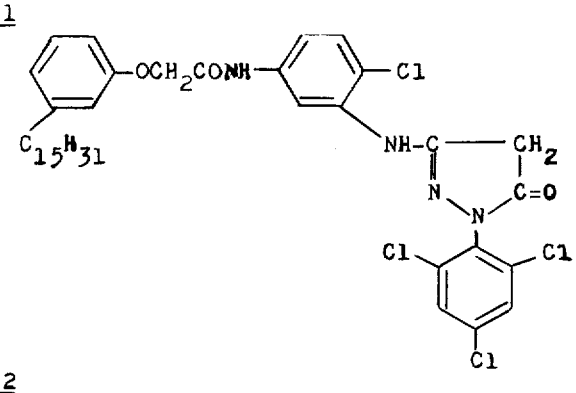

(I) - 2

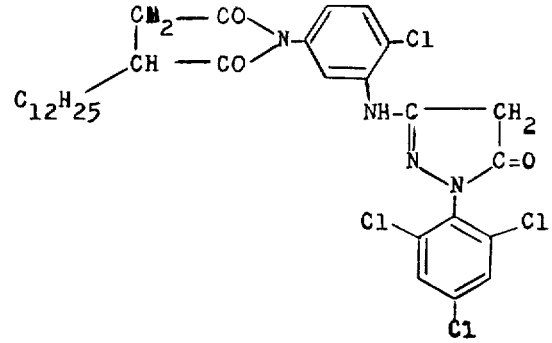

(I) - 3
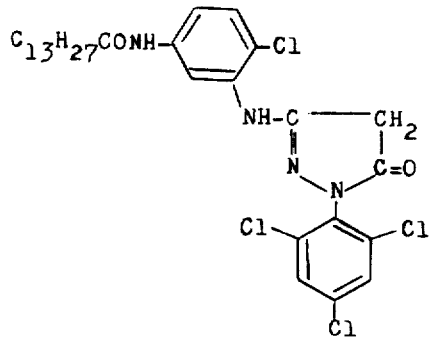
(I) - 4
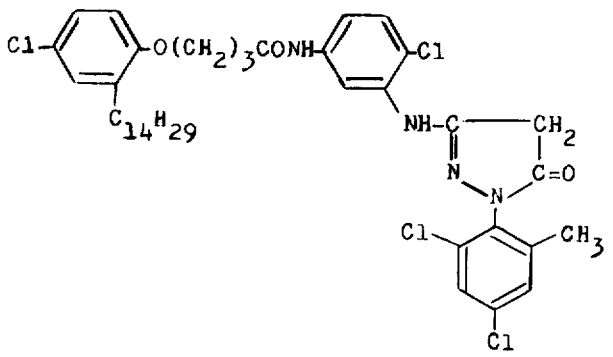
(I) - 5
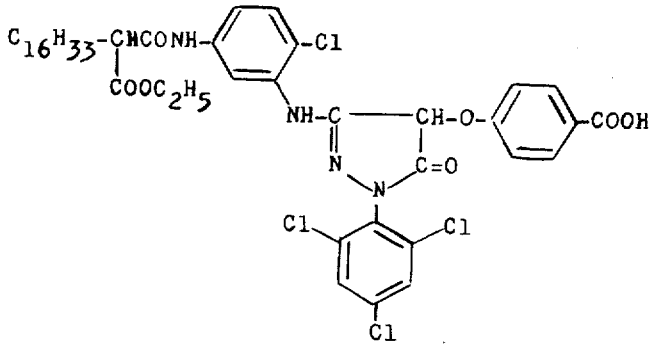
(I) - 6
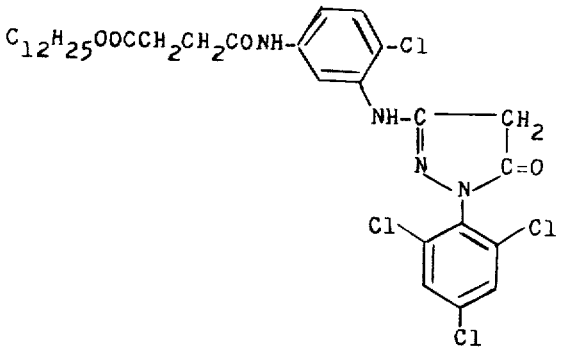

(I) - 7
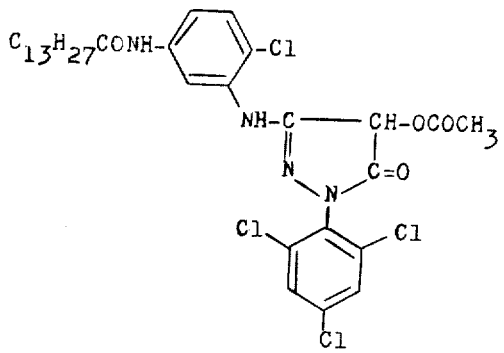
(I) - 8
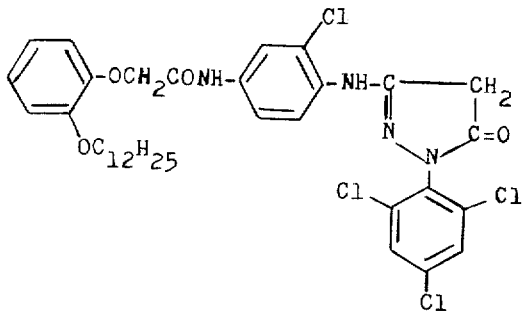
(I) - 9
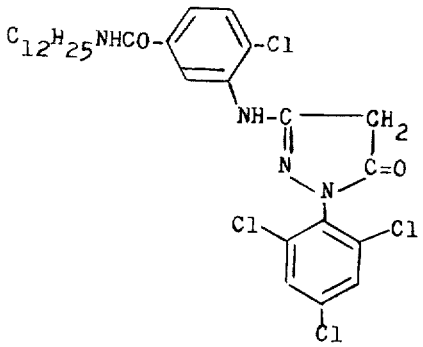
(I) - 10
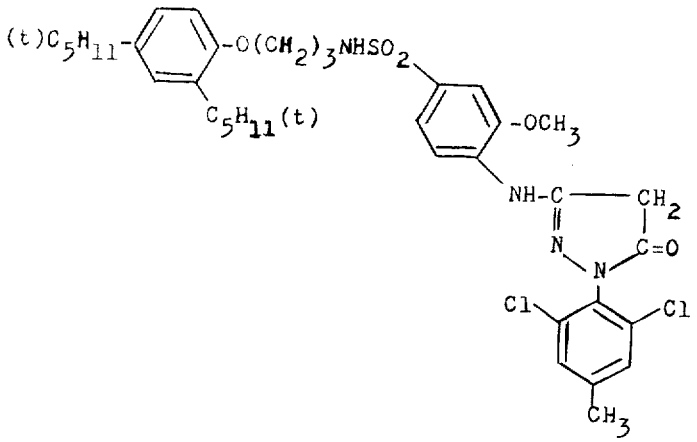

(I) - 11
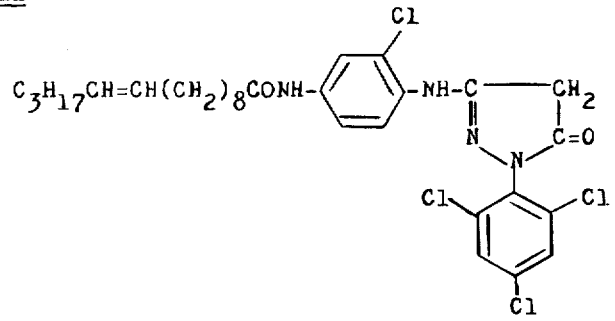
(I) - 12
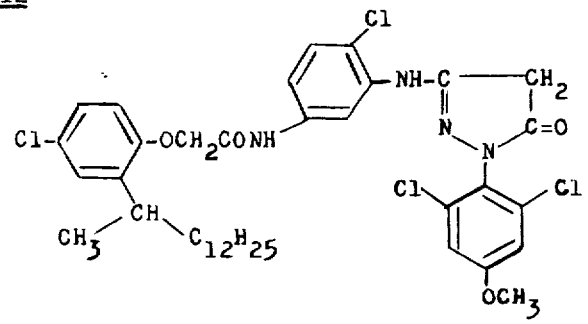
(I) - 13
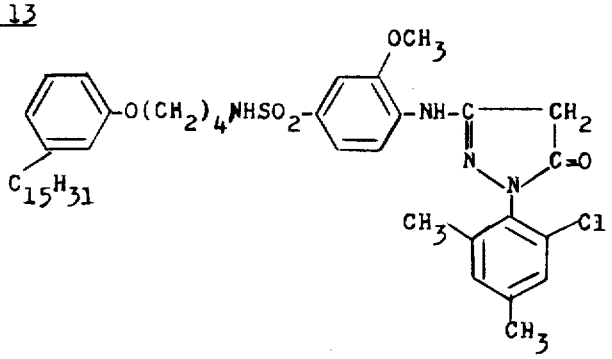
(I) - 14
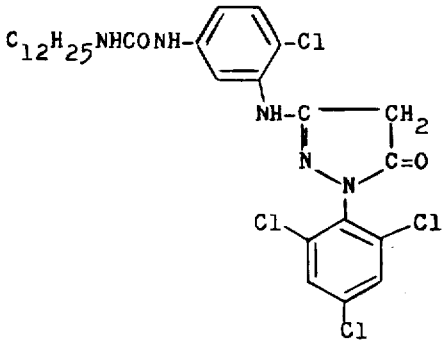
(I) - 15
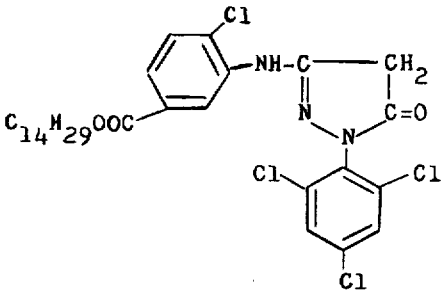

(I) - 16
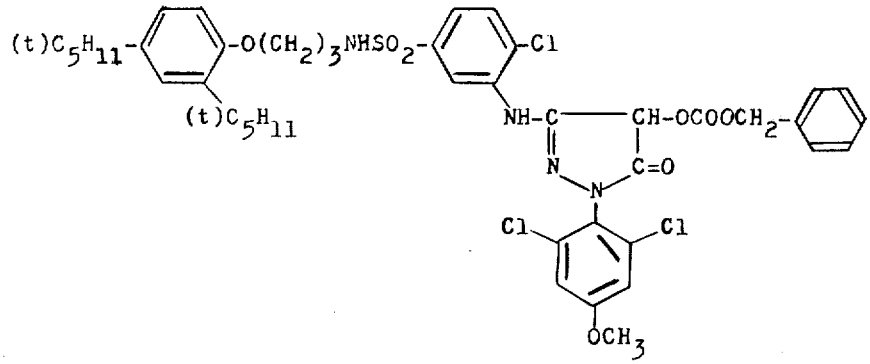
(I) - 17
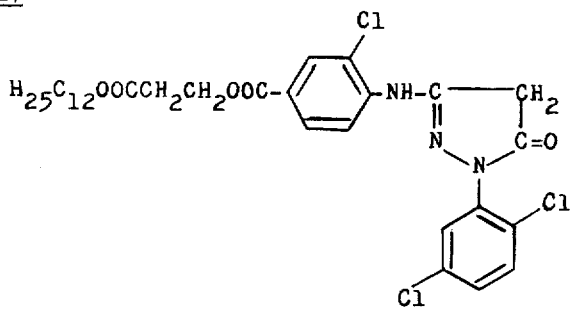
(I) - 18
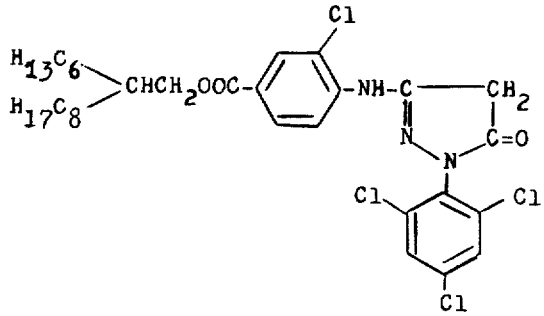
(I) - 19
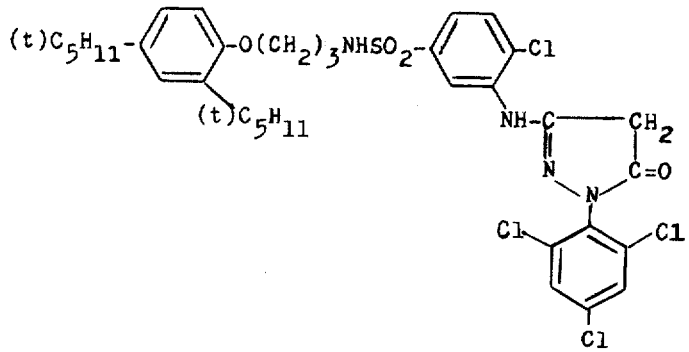

(I) - 20
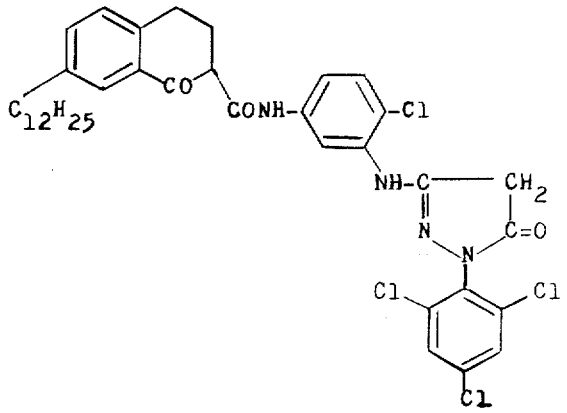
(I) - 21
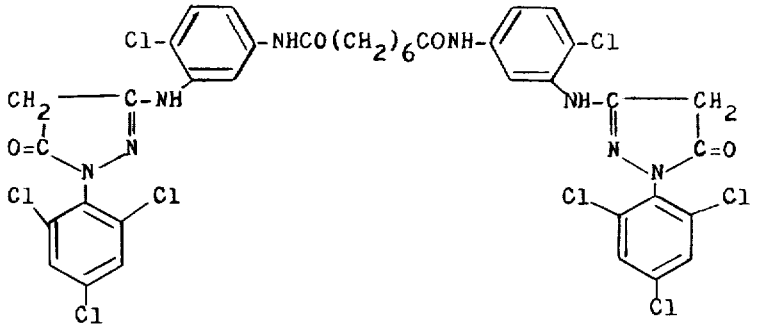
(I) - 22
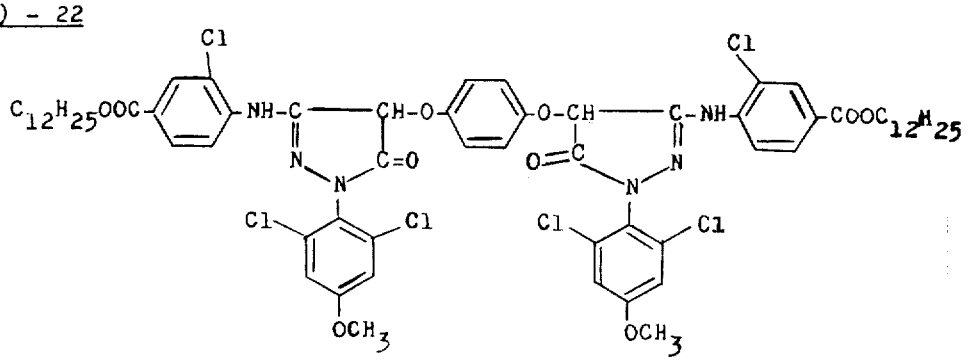
(I) - 23
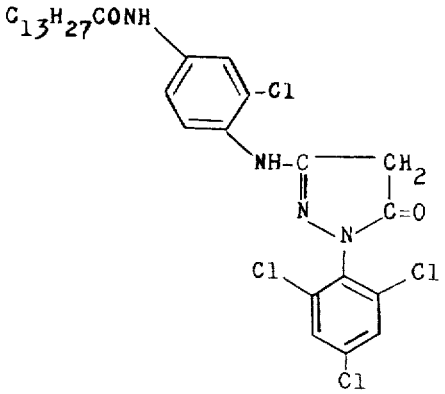

(I) - 24
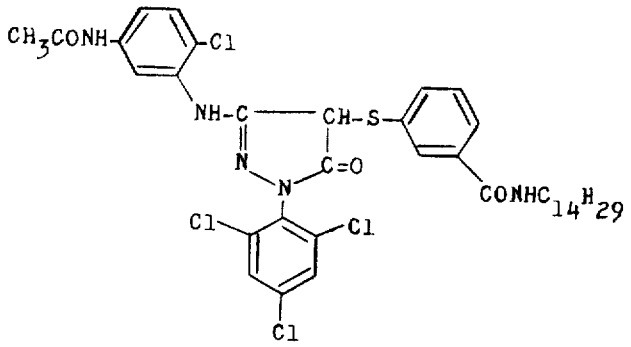
Specific examples of the hydroquinone type compound which can be used in this invention are illustrated below:
(II) - 1
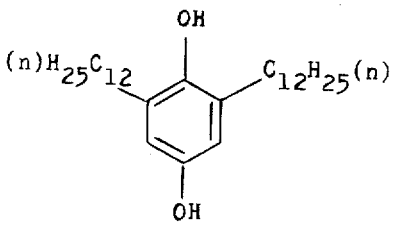
(II) - 2
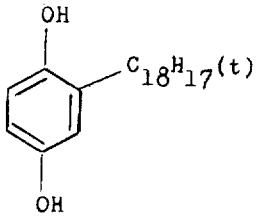
(II) - 3
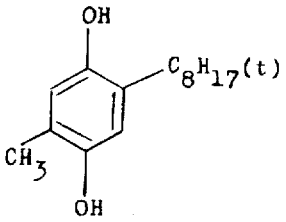
(II) - 4
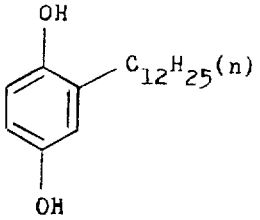
(II) - 5
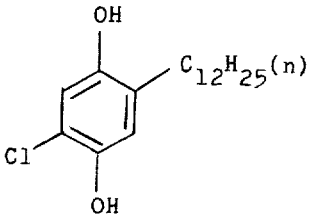
(II) - 6
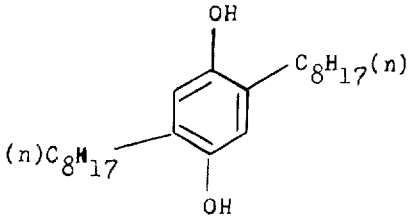

(II) - 7

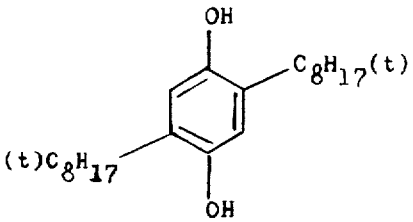

(II) - 8

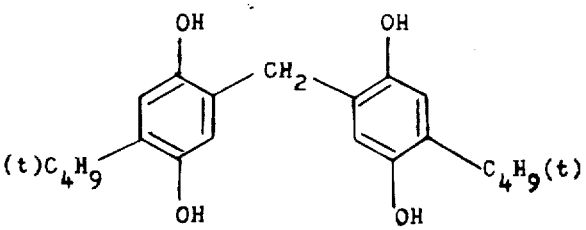

(II) - 9

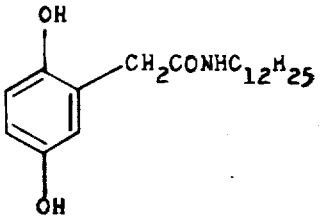

(II) - 10

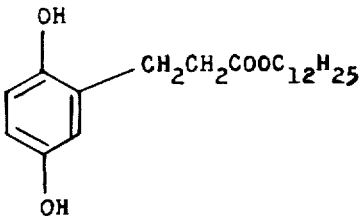

(II) - 11

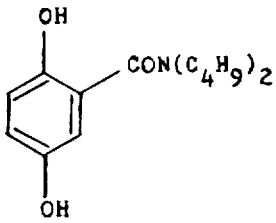

(II) - 12

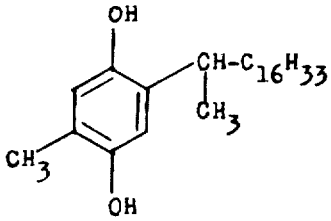

(II) - 13

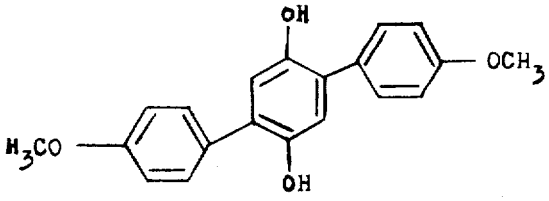

(II) - 14

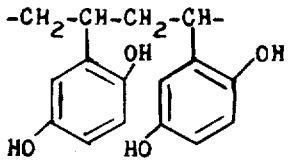

Mol.wt about 2000 - 5000

(II) - 15

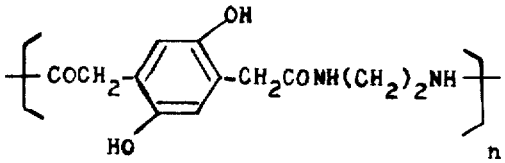

$20 < n < 50$

To produce the silver halide color photographic material of this invention using the above-described couplers, the magenta dye-forming coulers represented by general formula (I) can be used individually or as a combination of two or more of the couplers, suitably in an amount of about $1 \times 10^{-4}$ to $3 \times 10^{-3}$, preferably $5 \times 10^{-4}$ to $2 \times 10^{-3}$ mol/m² of the support, or further can be used together with magenta dye-forming coupler or couplers other than the couplers of general formula (I). For instance, the magenta coupler or couplers of general formula (I) may be used together with the coupler or couplers described in the specifications of U.S. Pat. Nos. 2,600,788; 2,908,573; 3,062,653; 3,419,391;

3,311,476; 2,725,292; 3,558,319 and 2,369,489 and British Patent No. 1,249,287. Furthermore, the coupler or couplers of this invention can be used in the same silver halide emulsion together with a magenta dye-forming coupler or couplers of an aqueous solution system. Still further, to improve the color reproducibility of color photographic materials, the magenta coupler or couplers of general formula (I) can be used together with cyan couplers

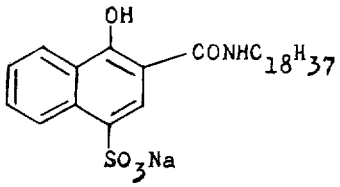

or

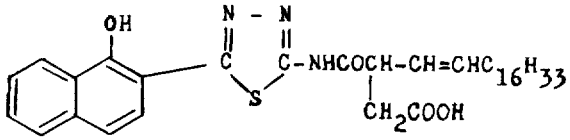

or a yellow coupler

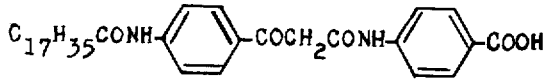

as described in the specification of Japanese patent publication No. 391/'65.

The hydroquinone type compounds represented by general formula (II) can also be used individually or as a combination of two or more such compounds. The amount of the hydroquinone type compound or compounds to be added differs depending on the type of color photographic material, the kind of development process, the kind of other magenta dye-forming coupler or couplers used in combination, and the kind of silver halide emulsion to which the coupler is added but in general an amount of from about 2 to 80% by weight, in particular 5 to 50% by weight to the weight of the magenta dye-forming coupler or couplers employed is suitable.

Moreover, the photographic emulsions containing the abovedescribed compounds in this invention can contain another anitoxidant or a reducing agent as described in U.S. Pat. Nos. 2,336,327; 2,360,290; 2,384,658; 2,418,613; 3,069,262; 3,457,079, etc., such as, for instance, sodium bisulfite, ascorbic acid, aminophenols, pyrogallols, gallates, catechols, resorcinols, tocopherols, hydroxylamine, and dihydroxynaphthalenes in an amount of about 0.1 to 20% by weight, preferably 1 to 10% by weight.

In another embodiment of this invention, the hydroquinone type compound of general formula (II) in this invention and/or the abovedescribed antioxidant can be incorporated in a color developer for the color photographic material.

The color photographic material of this invention is usually a so-called multilayer color photographic material having on a support at least two (usually three) differently sensitized silver halide emulsion layers and can have intermediate layers, a filter layer, a protective layer, etc., in addition to the silver halide photographic layers.

The support which can be used in this invention can be selected from a broad range of materials well known in the photographic field. For instance, there are illustrated, as such supports, a plastic film such as a cellulose acetate film, a polycarbonate film, a polyethylene terephthalate film, and a polystyrene film; a baryta-coated paper, a polyethylene-coated paper, and a glass sheet.

The hydrophilic colloid which can be used for the color photographic materials of this invention is a high molecular weight material capable of forming a film and permeable to a developing solution. Examples of such hydrophilic colloids are gelatin, polyvinyl alcohol, polyacrylate, polyacrylamide, a partially hydrolyzed product of polyvinyl acetate, polyacrylamide subjected to a Hofmann reaction, a copolymer of acrylic acid, acrylamide, and N-vinylimidazole, and sodium alginate.

The photographic emulsion can be hardened in a conventional manner. Examples of hardening agents which can be employed for this purpose are aldehyde compounds such as formaldehyde, glutaraldehyde, etc.; ketone compounds such as diacetyl, cyclopentandiene, etc.; reactive halogen containing compounds such as bis(2-chloroethylurea) and 2-hydroxy-4,6-dichloro-1,3,5-triazine, as disclosed in U.S. Pat. Nos. 3,288,775 and 2,732,303, British Pat. Nos. 974,723 and 1,167,207; compounds having a reactive olefinic group such as divinylsulfone, 5-acetyl-1,3-diacryloylhexahydro-1,3,5-triazine, etc., as described in the specifications of U.S. Pat. Nos. 3,635,718 and 3,232,763 and British Pat. No. 994,869; the N-methylol compounds such as N-hydroxymethylphthalimide; etc., as described in the specifications of U.S. Pat. Nos. 2,732,316 and 2,586,168; the isocyanates as described in the specification of U.S. Pat. No. 3,103,437; the organic carboxylic acid or sulfonic acid derivatives as described in the specifications of U.S. Pat. Nos. 2,725,294 and 2,725,295; the carbodiimide compounds as described in the specification of U.S. Pat. No. 3,100,704; the epoxy compounds as described in the specification of U.S. Pat. No. 3,091,537; the isooxazole compounds as described in the specifications of U.S. Pat. Nos. 3,321,313 and 3,543,292; halocarboxyaldehydes such as mucochloric acid; dioxane derivatives such as dihydroxydioxane, dichlorodioxane, etc.; and inorganic hardening agents such as chromium alum, zirconium sulfate, etc.

Also, precursors such as, for instance, an alkali metal bisulfitealdehyde addition product, a methylol derivative of hydantoin, and a primary aliphatic nitro alcohol can be used instead of the abovedescribed compounds as the hardening agent for the photographic emulsions.

The color photographic material of this invention is, after exposure, developed in a developer containing an aromatic primary amine developing agent, in particular a p-phenylenediamine developing agent, and thereafter bleached and fixed to form images composed of non-diffusible dyes in the hydrophilic colloid layers.

Typical examples of suitable developing agents are 4-amino-3-ethoxy-N,N-diethylaniline, 4-amino-3,5-dimethyl-N,N-diethylaniline, 4-amino-3-methyl-N-ethyl-N-(β-hydroxyethyl)-aniline, 4-amino-3-methyl-N,N-diethylaniline, 4-amino-3-methyl-N-ethyl-N-(β-methylsulfonamidoethyl)aniline, 4-amino-3-(β-methylsullfoneamidoethyl)-N,N-diethylaniline, 4-amino-N-ethyl-N-(β-hydroxyethylaniline, 4-amino-N,N-diethylaniline, 4-amino-N-ethyl-N-ω-sulfobutylaniline, etc.

The color developer containing the color developing agent can further contain additives conventionally used, such as an alkali metal sulfite, an alkali metal carbonate, an alkali metal bisulfite, an alkali metal bromide, an alkali metal iodide, and benzyl alcohol.

The light sensitive material of this invention can be bleached using conventional techniques after color development. This treatment solution can be a bleach fix bath by adding a fixing solution. Examples of suitable compounds which can be used in a bleaching solution, are polyvalent metal compounds such as ferricyanide salts, dichromates, water soluble cobalt (III) salts, water soluble copper (II) salts, water soluble quinones, nitrosophenols, iron (III), cobalt (III), copper (II) salts and, metal complexes with these polyvalent metal cations with malonic acid, tataric acid, malic acid, diglycolic acid, dithioglycolic acid and amino polycarboxylic acids such as ethylenediamine tetraacetic acid, nitrilotriacetic acid, iminodiacetic acid, and N-hydroxyethylethylenediaminetriacetic acid, the cupric complex salt of 2,6-dipicolinic acid, peroxides such as alkyl peroxides, permaganates, hydrogen peroxide, halogens such as chloride, bromide, and hypochlorites such as bleaching powder. To this solution, further, a bleaching accelerating agent or other additives as disclosed in U.S. Pat. Nos. 3,042,520 and 3,241,966, Japanese patent publication Nos. 8506/1970 and 8836/1970 can be added.

As the bleach solution which can be used for processing the color photographic materials of this invention, any solutions containing a known bleaching agent such as a ferricyanide, a bichromate, a chelate complex of ethylenediamine tetraacetic acid and Fe(III), etc., can be used. Also, any fixing solutions containing a known fixing agent such as sodium thiosulfate, potassium thiosulfate, etc., can be employed in this invention. Furthermore, the bleach step and the fix step can be conducted in the same bath and such as blix bath is described in, for instance, the specification of U.S. Pat. No. 3,582,322.

The silver halide emulsions which can be used in the present invention can be selected from a broad range of emulsions conventionally known in the art depending on the end use purposes of the photographic materials. Also, the silver halide used in this invention can be selected from silver chloride, silver chlorobromide, silver bromide, silver chloroiodobromide, silver iodobromide, etc. A suitable coating amount thereof is about $1 \times 10^{-3}$ to $3 \times 10^{-2}$, preferably $5 \times 10^{-3}$ to $2 \times 10^{-2}$ mol of silver/m² of the support.

The photographic silver halide emulsions used in this invention can be sensitized using sulfur sensitization, gold sensitization, reduction sensitization, etc.

The above described silver halide emulsion can be chemically sensitized using conventional techniques. Suitable examples of chemical sensitizers are auric compounds such as auric chloride compounds or auric tri chloride compounds as disclosed in U.S. Pat. Nos. 2,399,083, 2,540,085, 2,597,856, 2,597,915, etc., noble metal salts of platinum, palladium, iridium, rhodium, or ruthenium as disclosed in U.S. Pat. Nos. 2,448,060, 2,540,086, 2,566,245, 2,566,263, 2,598,079, etc.; sulphur compounds which react with silver salts to form silver sulfide as disclosed in U.S. Pat. Nos. 1,574,944, 2,410,689, 3,189,458, 3,501,313, etc.; reduction compounds of stannous salts or amine group compounds as disclosed in U.S. Pat. Nos. 2,487,850, 2,518,698, 2,521,925, 2,521,926, 2,694,637, 2,983,610, 3,201,254, etc.

The photographic emulsion can be spectrally sensitized or supersensitized employing well known techniques using cyanine dyes of cyanine, merocyanine, or carbocyanine type alone or in combination with styryl dyes. Suitable examples of sensitizers for the blue-sensitive layer are

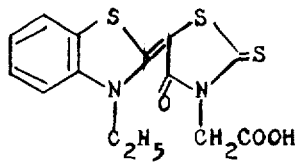

;

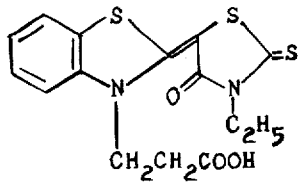

;

(CH2CH2SO3H)

(CH2CH2SO3H·N(C2H5)3)

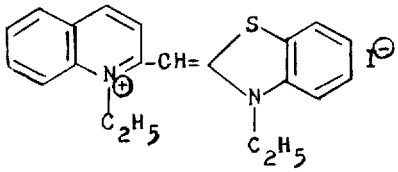

+

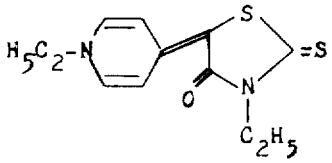

;

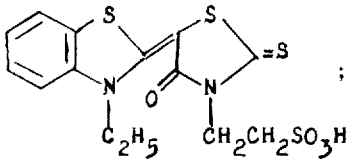
;
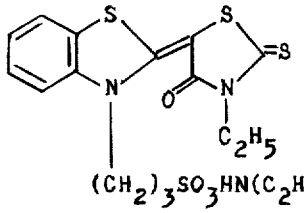
; or
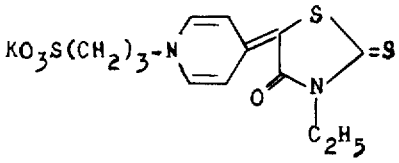
+
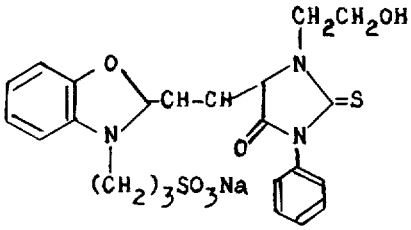
;
as disclosed in U.S. Pat. Nos. 2,493,748, 2,519,001, 2,977,229, 3,480,434, 3,672,897, 3,703,377, etc., for the green sensitive layer are
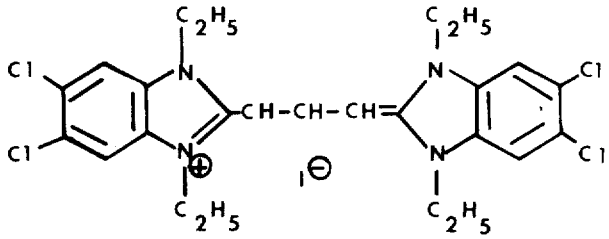
+
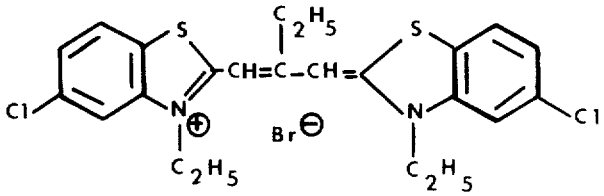
;
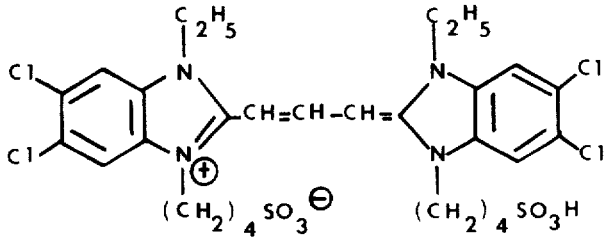
+

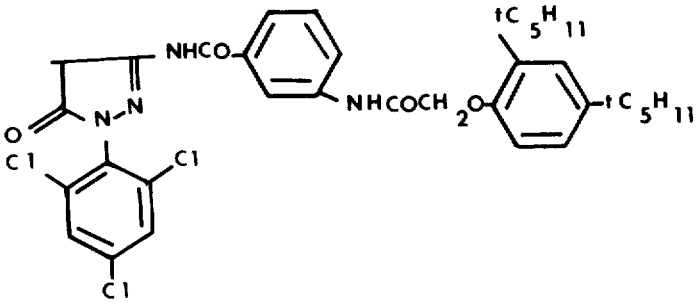
;
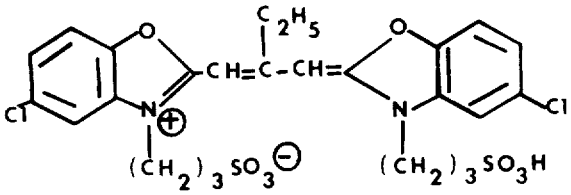
+
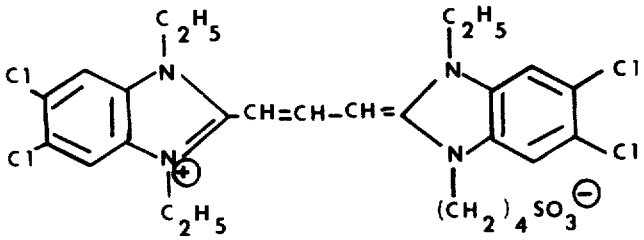
;
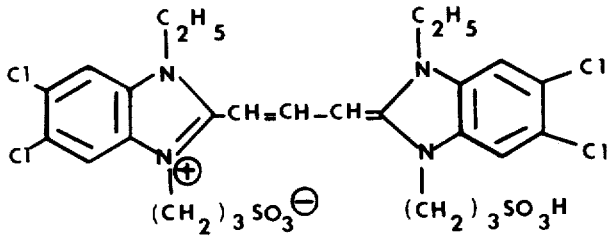
+
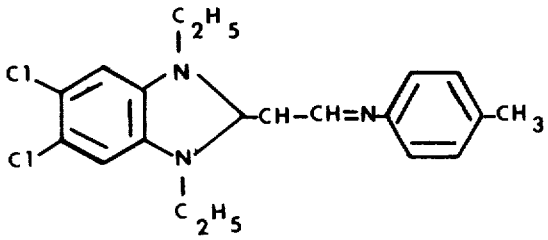
;
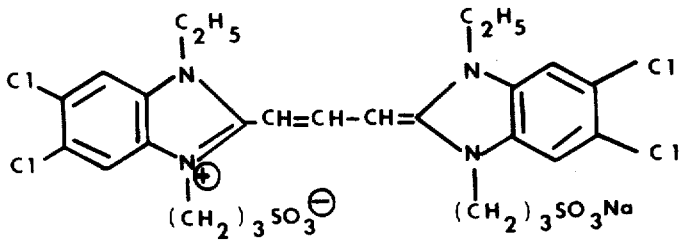

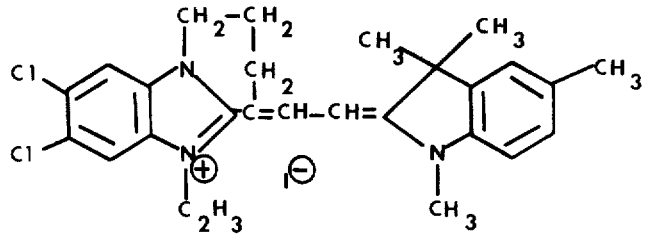
;
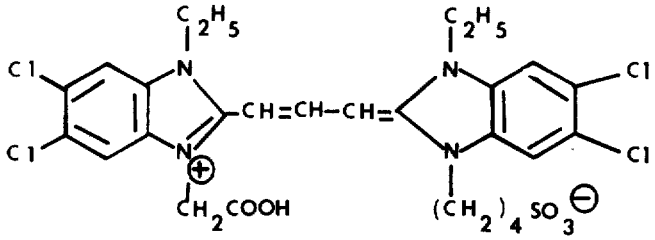
;
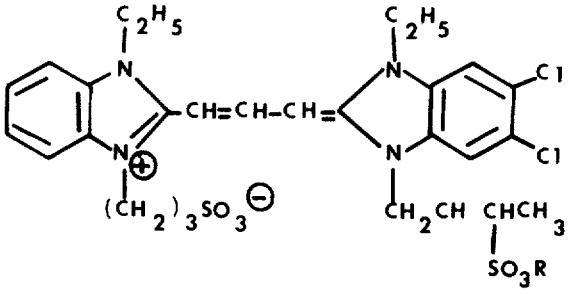
;
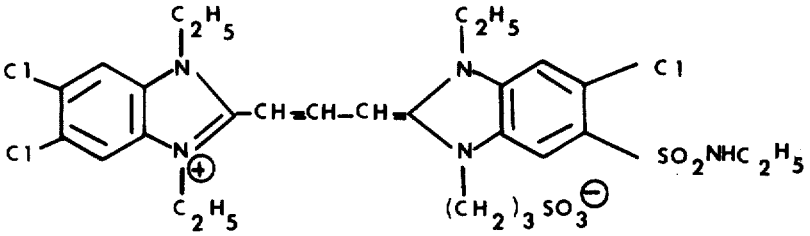
+
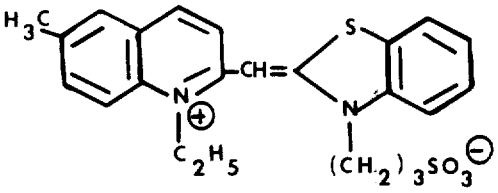
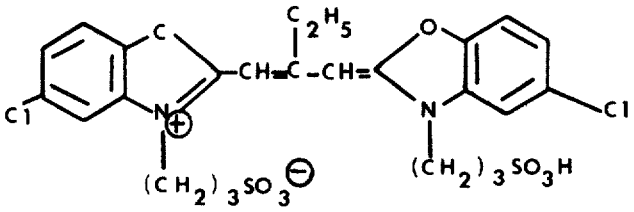
+

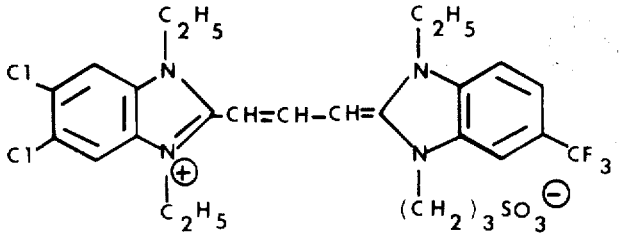
;
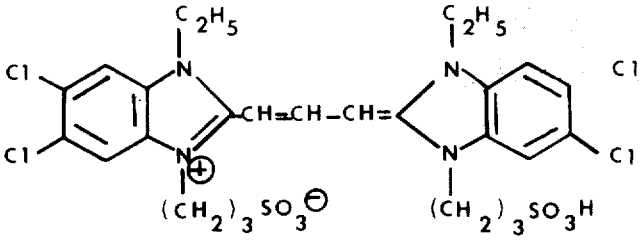
+
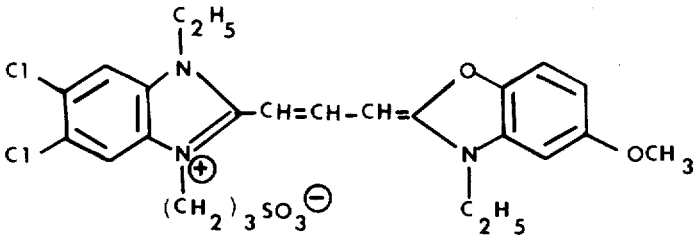
;
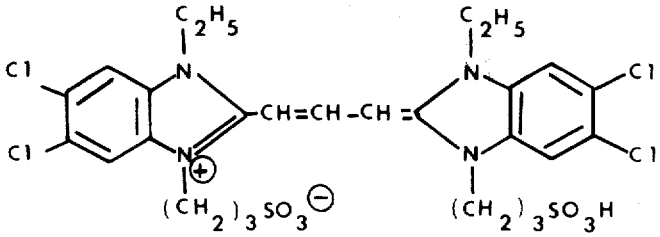
+
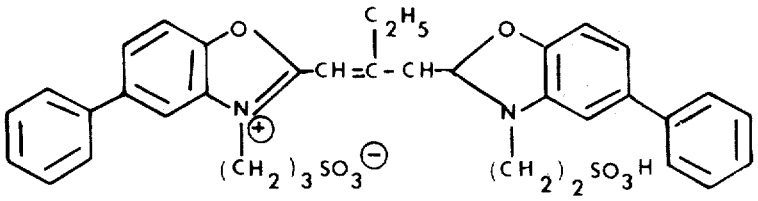
;

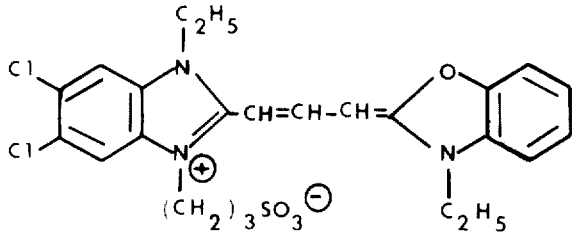
as disclosed in U.S. Pat. Nos. 2,688,545, 2,912,329, 3,397,060, 3,615,635, 3,628,964, British Pat. Nos. 1,195,302, 1,242,588, 1,293,862, West German Pat. OLS Nos. 2,030,326, 2,121,780, japanese patent Publication Nos. 4936/1968, 14030/1969, etc., and for the red sensitive layer are
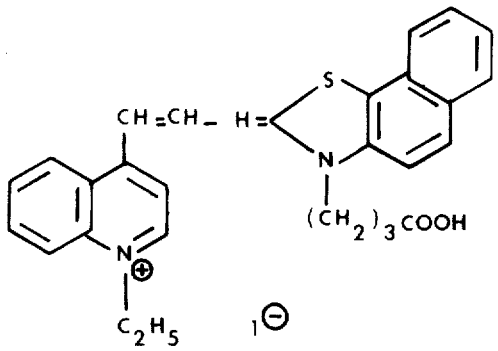
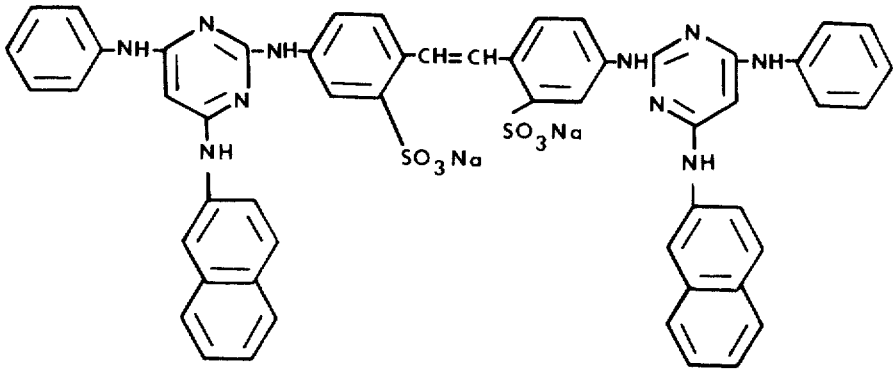
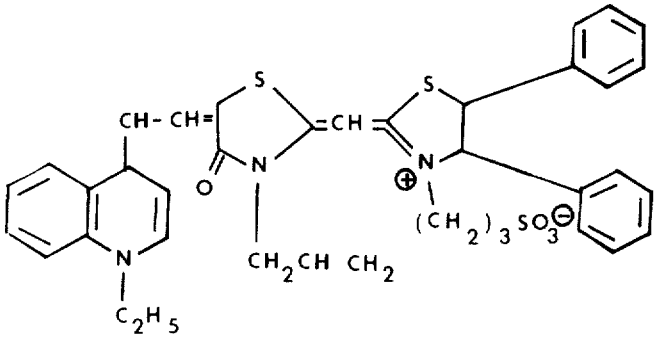

+
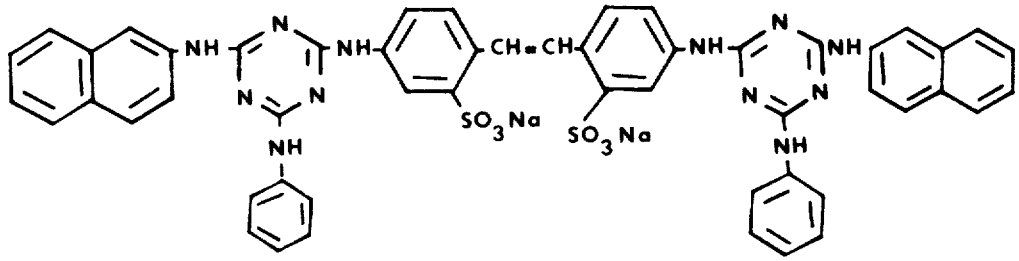
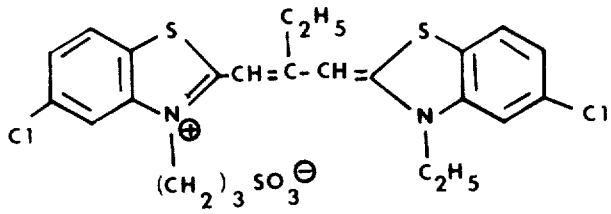
+
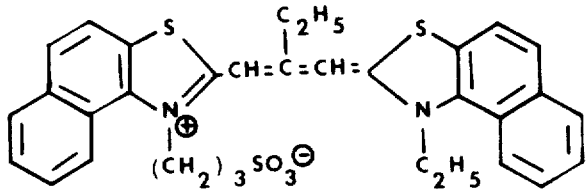
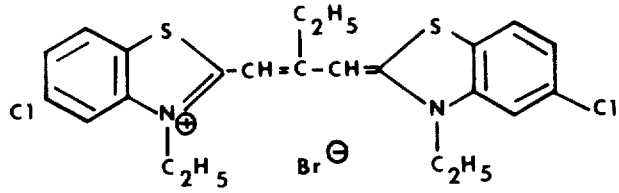
+
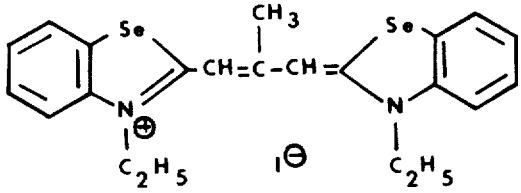
;

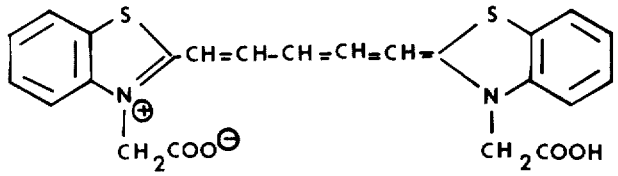
+
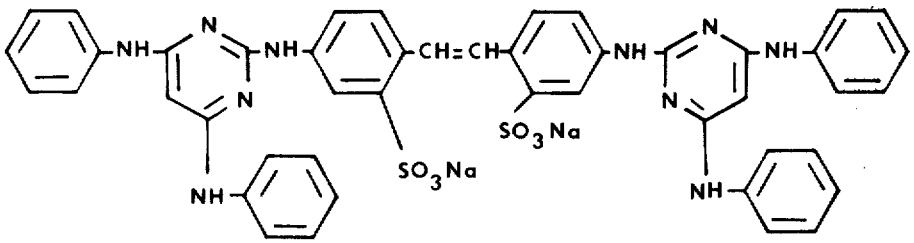
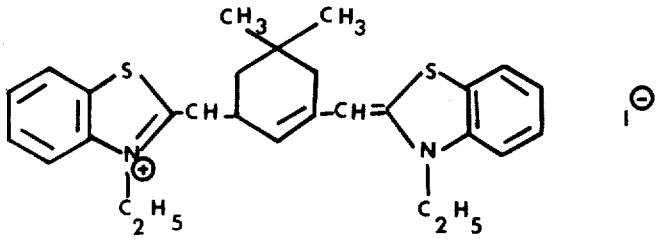
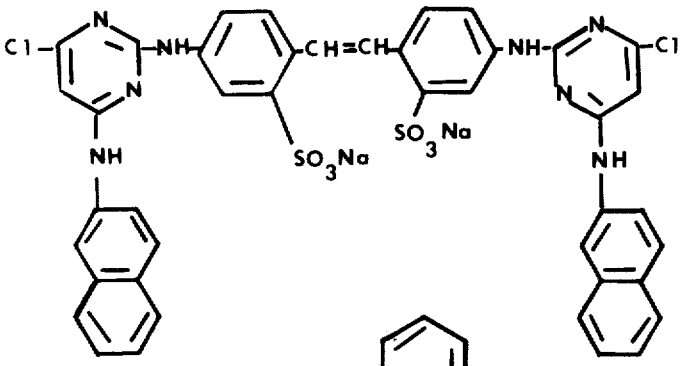
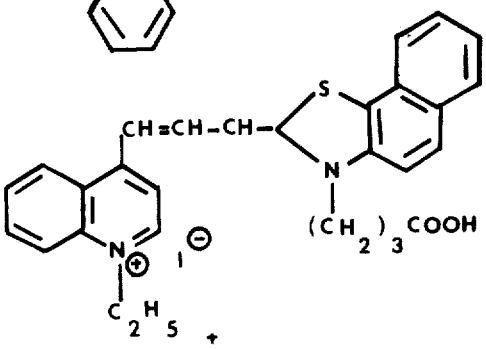

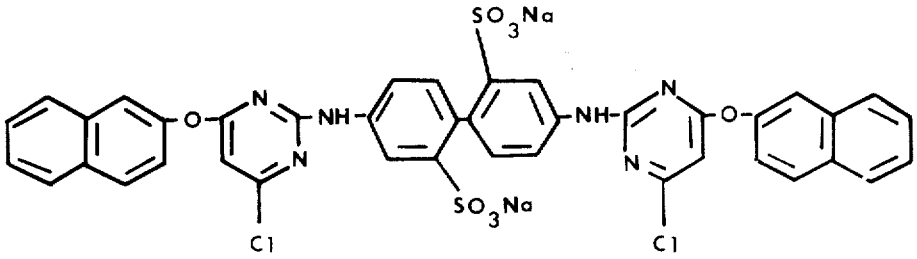
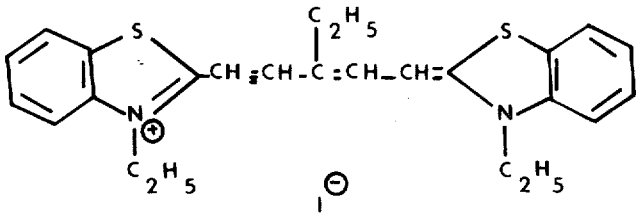
+
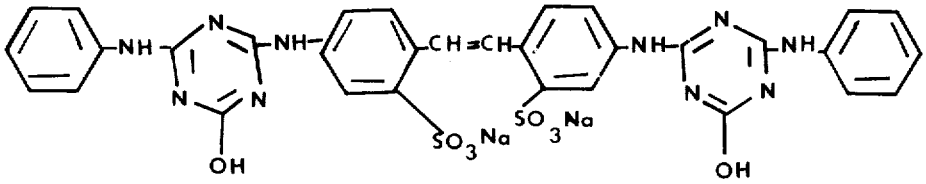
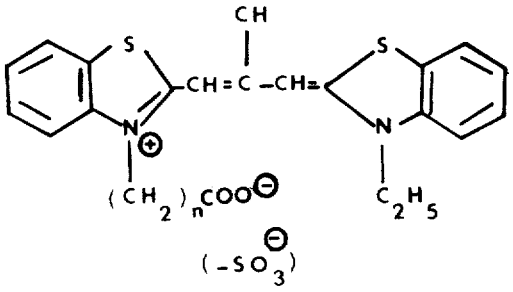
;
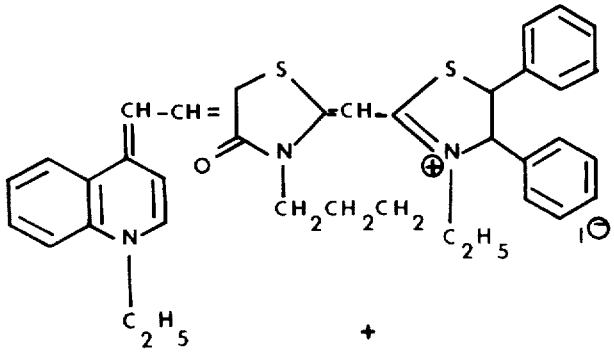
+

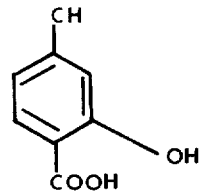

condensation product HCHO : or

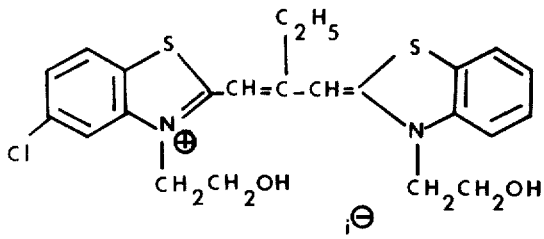

+

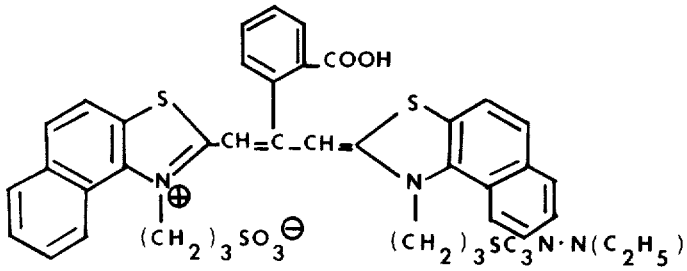

as disclosed in Japanese patent publication No. 10773/1968, U.S. Pat. Nos. 3,511,664, 3,522,052, 3,527,641, 3,619,613, 3,615,632, 3,617,295, 3,635,721, 3,694,217, British Pat. Nos. 1,137,580, 1,216,203, etc.

The above sensitizers can be easily chosen by one skilled in the art depending on the wave length absorption range, the degree of sensitivity, or the light sensitive material.

The photographic emulsions can further be stabilized using an agent for forming a sparingly soluble silver salt, such as a mercapto compound, e.g., 1-mercapto-5-phenyltetrazole and/or a stabilizer such as 5-methyl-6-oxy-1,3,4-triazaindolizine. For example the photographic emulsion can contain compounds added to prevent a reduction in the sensitivity and fogging during the manufacturing process or on storage. Typical compounds are 4-hydroxy-6-methyl-1,3,3a,7-tetrazaindene, 3-methyl-benzothiazole, 1-phenyl-5-mercaptotetrazole, heterocyclic compounds, mercury containing compounds, mercapto compounds, and metal salts. Additional examples which can be used are disclosed in Mees and James The Theory of the Photographic Process (3rd Edition, 1966), and also in, U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,622,339, and British Pat. Nos. 893,428, 403,789, 1,173,609, 1,200,188.

As the silver halide emulsions, conventional negative-type silver halide emulsions are particularly preferred in this invention but the silver halide emulsions of the type of containing a fogging agent and of forming internal latent images and further silver halide direct reversal emulsions of a solarization type can also be used.

The color photographic materials of this invention can be used for many purposes such as, for instance, color photographic positive films, color photographic printing papers, color photographic negative films, color photographic reversal films, etc.

The following examples are given to illustrate the present invention in greater detail but are not to be interpreted as limiting it in any way. Unless otherwise indicated all parts, percents, ratios and the like are by weight.

EXAMPLE 1

A coating composition containing a silver chlorobromide emulsion containing 85 mol percent bromine and a coupler dispersion prepared by dispersing a yellow coupler, α-2-methylbenzoyl-α-phthalimide-2'-methoxy-5'-n-dodecyloxycarbonylacetanilide using dibutyl phthalate and ethyl acetate was coated on a paper support having polyethylene layers in a thickness of 3.0 microns coated on both surfaces to provide a blue-sensitive emulsion layer (coated silver amount: $3.5 \times 10^{-3}$ mol/m², coated coupler amount: $1 \times 10^{-3}$) and then a gelatin solution was coated on the blue-sensitive emulsion layer in a thickness of 1.4 microns as an intermediate layer. Then, a coating composition prepared by dispersing the following components using a homogenizer and adding the coupler dispersion thus prepared to a silver chlorobromide emulsion containing 40 mol percent bromine and spectrally sensitized using a sensitizing dye having a sensitization maximum at about 545 mμ was coated on the intermediate layer in a thickness of 3.0 microns to provide a green-sensitive emulsion layer. (coated silver amount: $1 \times 10^{-2}$ mol/m², coated coupler amount: $1.4 \times 10^{-3}$ mol/m²).

| Component | Coupler Dispersion A | B | C | D | E | F | G | H |
|---|---|---|---|---|---|---|---|---|
| Coupler (I)-3 | 100 g | 100 g | — | — | — | — | — | — |
| Coupler (I)-15 | — | — | 100 g | 100 g | — | — | — | — |
| Coupler (I)-19 | — | — | — | — | 100 g | 100 g | — | — |
| Known Coupler A* | — | — | — | — | — | — | 100 g | 100 g |
| Hydroquinone | — | 10 g | — | 10 g | — | 10 g | — | 10 g |
| Compound (II)-2 | | | | | | | | |
| Dibutyl Phthalate | 100 g | 10 g | — | 10 g | — | 10 g | — | 10 g |
| Ethyl Acetate | 200 g | 10 g | — | 10 g | — | 10 g | — | 10 g |
| 10% Aqueous Gelatin Solution | 1000 g | 10 g | — | 10 g | — | 10 g | — | 10 g |
| 5% Aqueous Solution of Sodium Dodecylbenzenesulfonate | 50 g | 10 g | — | 10 g | — | 10 g | — | 10 g |

Known coupler*:
1-Phenyl-3-[3-(2-carboxymethyleicos-3-enamido)-benzamido]-5-pyrazolone described in U.S. Patent No. 3,468,666.

A gelatin solution containing 2-(2'-hydroxy-3'-methyl-5'-sec.-butylphenyl)benzotriazole as an ultraviolet absorbing agent was coated (0.8 g/m²) on the green-sensitive emulsion layer in a thickness of 2.3 microns as an intermediate layer and then a coating composition prepared by dispersing a cyan coupler, 4,6-dichloro-3-methyl-2-[α-(2,4-di-tert-amylphenoxy)acetamido]-phenol using dibutyl phthalate and ethyl acetate and adding the coupler dispersion to a silver chlorobromide emulsion containing 40 mol percent bromine and spectrally sensitized using a sensitizing dye having a sensitization maximum at about 685 mμ was coated on the intermediate layer in a thickness of 2.6 microns (coated silver amount: $2.9 \times 10^{-3}$ mol/m², coated coupler amount $1.1 \times 10^{-3}$ mol/m²). Finally, a gelatin solution was coated on the emulsion layer in a thickness of 1.0 micron as a protective layer.

Thus, Samples A to H were prepared.

The samples thus prepared were stepwise exposed through a wedge using a blue filter transmitting light of 400 – 500 mμ, a green filter transmitting light of 500 – 600 mμ, and a red filter transmitting light 600 μ 700 mμ and then processed in the following steps:

| Step | Temperature | Time |
|---|---|---|
| Color Development | 30°C | 4 min. |
| Blix | 30°C | 2 min. |
| Wash | 30°C | 2 min. |
| Stabilization | 30°C | 2 min. |

The compositions of the processing solutions used in the above steps were as follows:

| Color Developer | | |
|---|---|---|
| Sodium Metaborate | 25 | g |
| Sodium Sulfite | 2 | g |
| Hydroxylamine (sulfate) | 2 | g |
| Potassium Bromide | 0.5 | g |
| 6-Nitrobenzimidazole (nitrate) | 0.02 | g |
| Sodium Hydroxide | 4 | g |
| Benzyl Alcohol | 15.8 | ml |
| Diethylene Glycol | 20 | ml |
| N-Ethyl-N-β-(methanesulfonamidoethyl)-p-phenylenediamine | 8 | g |
| Water added to make | 1000 | ml |

| Blix Solution: | | |
|---|---|---|
| Iron Salt of ethylenediamine Tetraacetic Acid | 45 | g |
| Ammonium Thiocyanate | 10 | g |
| Sodium Sulfite | 10 | g |
| Ammonium Thiosulfate (60%) | 100 | ml |
| Tetrasodium Ethylenediamine Tetraacetate | 5 | g |
| Water added to make | 1000 | ml |

| Color Developer | | |
|---|---|---|
| Stabilization Bath: | | |
| Tartaric Acid | 10 | g |
| Zinc Sulfate | 10 | g |
| Sodium Metaborate | 20 | g |
| Water added to make | 1000 | ml |

Then, to demonstrate the effect of the addition of Compound (II)-2, the color mixing (the magenta-colored extent in the yellow-colored portion of the blue-sensitive emulsion layer), the green sensitivity, and the magenta fog of each sample were measured, the results being shown in Table 1.

The numerical value of the color mixing shown in Table 1 is the density of the magenta component (green filter density) in the yellow density 1.5 (blue filter density) of the blue-sensitive emulsion layer, from which the magenta fog value was subtracted. That is, a larger numerical value of the color mixing shows that the magenta-colored extent in the yellow colored portion is larger. The numerical value of the green sensitivity shows the reduction in sensitivity by the addition of Compound (II)-2 for each coupler when the sensitivity of the sample not containing Compound (II)-2 was assumed to be O. For instance, the value "–0.06" means that the sensitivity was reduced by 0.06 as logarithmic unit.

Table 1

| | Sample | | | | | | | |
|---|---|---|---|---|---|---|---|---|
| | A | B | C | D | E | F | G | H |
| Color Mixing | 0.49 | 0.30 | 0.47 | 0.28 | 0.52 | 0.31 | 0.29 | 0.20 |
| Green Sensitivity | 0 | −0.06 | 0 | −0.07 | 0 | −0.06 | 0 | −0.08 |
| Fog | 0.16 | 0.14 | 0.16 | 0.14 | 0.16 | 0.14 | 0.15 | 0.14 |

As is clear form the above results, Compound (I)-3, Compound (I)-15, and Compound (I)-19 gave large color mixing as compared with the control sample but on combination with Compound (II)-2, the occurence of color mixing was reduced remarkably. Also, when the combination of compounds was employed, the formation of fog was controlled without lowering the sensitivity.

EXAMPLE 2

A coating composition containing a silver chlorobromide emulsion containing 85 mol percent bromine and a coupler dispersion prepared by dispersing a yellow coupler, α-2-methylbenzoyl-α-phthalimido-2'-methoxy-5'-n-dodecyloxycarbonylacetanilide using dibutyl phthalate and ethyl acetate was coated on a paper support having polyethylene layers coated on both surfaces to provide a blue-sensitive emulsion layer (coated silver amount $2.9 \times 10^{-3}$ mol/m², coated coupler amount $1.1 \times 10^{-3}$ mol/m²) and further a gelatin solution was coated on the blue-sensitive layer as an intermediate layer, in this case, however, the intermediate layer of Sample M only was formed by coating a gelatin solution containing 1.2 g/m² of a dispersion prepared by dispersing Compound (II)-7 using dibutyl phthalate and ethyl acetate. Then, a coating composition prepared by dispersing a sensitizing dye having a sensitization maximum at about 545 mμ and the following components using a homogenizer and adding 100 g of the coupler dispersion thus prepared to 100 g of a silver halide emulsion (0.07 mol of silver) containing 50 mol percent bromine was coated on the intermediate layer. (coated silver amount: $1 \times 10^{-2}$ mol/m², coated coupler amount: $1.4 \times 10^{-3}$ mol/m²).

| Component | Coupler Dispersion | | | | | |
|---|---|---|---|---|---|---|
| | I | J | K | L | M | N |
| Coupler (I)-3 | 100 g | 100 g | 100 g | 100 g | 100 g | — |
| Known Coupler B* | — | — | — | — | — | 100 g |
| Compound (II)-7 | — | 10 g | 20 g | 30 g | 10 g | — |
| Dibutyl Phthalate | 100 g | 10 g | 20 g | 30 g | 10 g | — |
| Ethyl Acetate | 200 g | 10 g | 20 g | 30 g | 10 g | — |
| 10% Aqueous Gelatin Solution | 1000 g | 10 g | 20 g | 30 g | 10 g | — |
| 5% Aqueous Solution of Sodium Dodecylbenzenesulfonate | 50 g | 10 g | 20 g | 30 g | 10 g | — |

Known Coupler B: 1-(2,4,6-trichlorophenyl)-3- 3-[α-(2,4-di-tert-amylphenoxy)butylamido]-benzamido -5-pyrazolone.

Furthermore, a gelatin solution containing a ultraviolet absorbing agent, 2-(2'-hydroxy-3'-methyl-5'-sec-butylphenyl)-benzotriazole was coated (0.8 g/m²) on the emulsion layer as an intermediate layer (incorporating therein further 8 g/m² of a dispersion prepared by dispersing Compound (II)-7 using dibutyl phthalate and ethyl acetate in the case of Sample M only). Then, a coating composition prepared by adding a coupler dispersion prepared by dispersing a cyan coupler, 4,6-dichloro-3-methyl-2-[α-(2,4-di-tert-amylphenoxy)acetamido]phenol using dibutyl phthalate and ethyl acetate to a silver chlorobromide emulsion containing 40 mol percent bromine together with a sensitizing dye having a sensitization maximum at about 685 mμ was coated (coated silver amount $2.9 \times 10^{-3}$ mol/m², coated coupler amount: $1.1 \times 10^{-3}$ mol/m²) on the intermediate layer and finally a gelatin solution was coated on the silver halide emulsion layer as a protective layer. Thus, Samples I to N were prepared.

The samples thus prepared were exposed and processed as described in Example 1.

By measuring the color mixing on each sample thus processed, the effect of the addition of Compound (II)-7 was demonstrated. The results thereof are shown in Table 2, in which the numerical values of color mixing (X) are the cyan component density (red filter density) in the magenta density 2.0 (green filter density) of the green-sensitive emulsion layer and the numerical values of color mixing (Y) are the magenta component density (green filter density in the yellow density 1.5 (blue-filter density) of the blue-sensitive emulsion layer, and from each density the cyan fog value and the magenta fog value have been subtrated.

Table 2

| | Sample | | | | | |
|---|---|---|---|---|---|---|
| | I | J | K | L | M | N |
| Color Mixing (X) | 0.28 | 0.28 | 0.27 | 0.27 | 0.14 | 0.14 |
| Color Mixing (Y) | 0.49 | 0.30 | 0.22 | 0.19 | 0.20 | 0.19 |

From the above results, it can be understood that the combination of Coupler (I)-3 and Compound (II)-7 according to the present invention in effective to prevent the occurence of color mixing. Also, it can be understood that the cyan color mixing (Y) in the green-sensitive emulsion layer can be effectively prevented by incorporating Compound (II) of this invention in the green-sensitive emulsion layer and the adjacent intermediate layer thereto.

EXAMPLE 3

The stability of couplers in solution was determined. The compositions of the sample solutions determined were as follows:

| Component | Coupler Dispersion O | P | Q | R | S | T |
|---|---|---|---|---|---|---|
| Coupler (I)-19 | 100 g | 100 g | — | — | — | — |
| Coupler (I)-23 | — | — | 100 g | 100 g | — | — |
| Known Coupler A | — | — | — | — | 100 g | 100 g |
| Coupler (II)-7 | — | 5 g | — | 5 g | — | 5 g |
| Dibutyl Phthalate | 100 g | 5 g | — | 5 g | — | 5 g |
| Ethyl Acetate | 200 g | 5 g | — | 5 g | — | 5 g |

The color of the solutions directly after the preparation thereof and the change of the color after allowing the solutions to stand for 12 hours at room temperature (about 20° – 30°C) were observed. By these tests, it was demonstrated that Sample Q was greatly blackened and Sample O was blackened considerably, while Sample S was substantially not discolored. On the other hand, Samples P and R which corresponded to Samples O and Q containing further Compound (II)-7 were not discolored. Sample T also was no discolored.

Thus, it can be understood that the addition of Compound (II) of this invention to Compound (I) has the effect of stabilizing Compound (I) in solution, Compound (I) being unstable in solution when it is alone present therein.

EXAMPLE 4

The occurence of yellow stains in the processing of Samples A to H as prepared in Example 1 due to the influence of formaldehyde was investigated. First of all, the results obtained by conducting the processings as in Example 1 without using formaldehyde (no exposure) are shown in Table 3, in which the yellow densities directly after processing and after exposing to severe conditions of 80°C for 7 days are shown.

Table 3

| Yellow Stain | Sample A | B | C | D | E | F | G | H |
|---|---|---|---|---|---|---|---|---|
| Immediately | 0.16 | 0.16 | 0.16 | 0.16 | 0.16 | 0.16 | 0.16 | 0.16 |
| After 7 Days at 80°C | 0.25 | 0.21 | 0.26 | 0.22 | 0.26 | 0.20 | 0.20 | 0.19 |

Then, the processing using the color development and the blix solution having the same compositions as described in Example 1 and also using the stabilization bath having the same composition as described in Example 1 having, further, added thereto, 10 ml of formaldehyde (38%) was conducted. The results obtained are shown in Table 4. In this case, the samples were not exposed. In the table the yellow densities immediately after treatment and after 7 days at 80°C are shown.

Table 4

(yellow stain)

| Yellow Stain | Sample A | B | C | D | E | F | G | H |
|---|---|---|---|---|---|---|---|---|
| Immediately | 0.16 | 0.16 | 0.16 | 0.16 | 0.16 | 0.16 | 0.16 | 0.16 |
| After 7 Days at 80°C | 0.25 | 0.21 | 0.26 | 0.22 | 0.26 | 0.21 | 0.20 | 0.19 |

From the above results it can be understood that the combinations of Compound (II)-2 and each of Couplers (I)-3, (I)-15, and (I)-19 are effective to prevent the formation of yellow stains with the passage of time after processing regardless of the absence or presence of formaldehyde.

EXAMPLE 5

A subbing layer was formed on a surface of a cellulose acetate film support having on the opposite surface thereof an antihalation layer containing carbon black and then a coating composition containing a silver iodobromide emulsion containing 1.2 mol percent iodine and a coupler dispersion prepared by dispersing a yellow coupler, α-(2methylbenzoyl)-3-[α-(2,4-di-tert-amylphenoxy)acetamido]-acetanilide using dibutyl phthalate and ethyl acetate was coated on the subbing layer to provide blue-sensitive layer (coated silver amount: $1.1 \times 10^{-2}$ mol/m² coated coupler amount $1.8 \times 10^{-3}$ mol/m²). Then, a gelatin solution was coated on the blue-sensitive emulsion layer as an intermediate layer and further a coating composition containing a silver chlorobromide emulsion containing 30 mol percent bromine and a coupler dispersion prepared by dispersing a cyan coupler, 1-hydroxy-4-chloro-N-hexadecyl-N-(2-cyanoethyl)-2-naphthamide using dibutyl phthalate and ethyl acetate was coated on the intermediate layer as a red-sensitive emulsion layer (coated silver amount: $4.2 \times 10^{116\ 3}$ mol/m², coated coupler amount: $1.4 \times 10^{-3}$ mol/m²). Then, a gelatin solution was coated on the red-sensitive layer as an intermediate layer and further a coating composition prepared by dispersing the following components using a homogenizer and adding 250 g of the coupler dispersion thus prepared to 100 g of silver chlorobromide emulsion (containing 0.06 mol of silver) containing 35 mol percent bromine, the silver halide emulsion having been spectrally sensitized so that it had a sensitization maximum at about 555 mμ was coated on the intermediate layer to provide a green-sensitive emulsion layer (coated silver amount: $6.0 \times 10^{-5}$ mol/m², coated coupler amount $1.2 \times 10^{-5}$ mol/m²). Finally, a gelatin solution was coated on the emulsion layer as a protective layer. Thus, Samples U to Z were prepared.

| Component | Coupler Dispersion U | V | W | X | Y | Z |
|---|---|---|---|---|---|---|
| Coupler (I)-3 | 90 g | 90 g | 90 g | — | — | — |
| Coupler (I)-15 | — | — | — | 72 g | 72 g | — |
| Known Coupler B | — | — | — | 26 g | 26 g | 100 g |
| Hydroquinone Compound (II)-2 | — | 0.23 | 0.46 g | — | 0.24 g | — |
| Dibutyl Phthalate | 50 g | 50 g | 50 g | 50 g | 50 g | 50 g |
| Ethyl Acetate | 200 g | 200 g | 200 g | 200 g | 200 g | 200 g |
| 10% Aqueous Gelatin Solution | 1000 g | 1000 g | 1000 g | 1000 g | 1000 g | 1000 g |
| Aqueous Solution of Sodium Dodecylbenzene Sulfonate | 100 g | 100 g | 100 g | 100 g | 100 g | 100 g |

Each of the samples thus prepared was exposed as described in Example 1 and then processed by the following steps:

| Step | Temperature | Time |
|---|---|---|
| Pre-treatment | 27°C | 10 sec. |
| Wash | " | 15 sec. |
| Color Development | " | 5 min. 20 sec. |
| Wash | " | 15 sec. |
| Blix | " | 4 min. |
| Wash | " | 2 min. |
| Stabilization | " | 10 sec. |

The compositions of the processing solutions used in the above steps were as follows:

| Pre-treatment Bath: | |
|---|---|
| Water | 800 ml |
| Sodium Carbonate (mono-hydrate) | 10 g |
| Sodium Sulfate (anhydrous) | 50 g |
| Water added to make | 1000 ml |
| **Color Developer:** | |
| Water | 800 ml |
| Sodium Sulfite (anhydrous) | 4 g |
| Sodium Hexametaphosphate | 2 g |
| 2-Amino-5-diethylaminotoluene Hydrochloride | 3 g |
| Sodium Carbonate (monohydrate) | 25 g |
| Potassium Bromide | 20 g |
| Water added to make | 1000 ml |
| **Stabilization Bath:** | |
| Water | 800 ml |
| 40% Aqueous-Solution of Polyethylene Glycol Having Molecular Weight of 400 | 5 ml |
| Water added to make | 1000 ml |

The green sensitivity and the magenta fog of the sample thus processed were measured in each case and the results obtained are shown in Table 5, in which the sensitivity is expressed by each relative sensitivity when the sensitivity of the control example Z was assumed to be 100.

Table 5

| | Sample U | V | W | X | Y | Z |
|---|---|---|---|---|---|---|
| Green Sensitivity | 134 | 115 | 106 | 110 | 100 | 100 |
| Fog | 0.47 | 0.06 | 0.05 | 0.17 | 0.06 | 0.07 |

From these results it can be understood that the combination of the compounds according to the present invention make it possible to use practically the couplers which give too much fog to be practically used. Also, the combination of Compound (II) and a mixture of Coupler (I) and a magenta coupler other than the couplers of this invention can also prevent the formation of fog.

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having coated thereon a silver halide emulsion layer containing a magenta dye forming coupler having a 3-anilino-5-pyrazolone ring and at least one hydrophobic residue of 8 to 32 carbon atoms, the ortho position of the anilino group at the 3-position of said pyrazolone ring being substituted with a halogen atom, an alkyl group, an alkoxyl group, an amide group, an aryl group, an aryloxy group, a cyano group, a nitro group, a hydroxyl group, or an amino group, and at least one of said silver halide emulsion layer and a hydrophilic colloic layer adjacent said silver halide emulsion layer containing a hydroquinone compound having at least one substituent of at least 8 carbon atoms or a hydroquinone precursor capable of providing said hydroquinone compound upon hydrolysis.

2. The color photographic material of claim 1, in which said magenta dye forming coupler is a compound represented by the general formula (I)

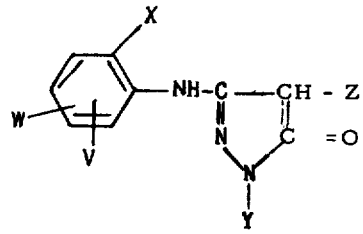

wherein X represents a straight chain or branched alkyl group having 1 to 12 carbon atoms, an alkoxyl group, an aryl group, an aryloxy group, an amino group, an amide group, a halogen atom, a hydroxyl group, a cyano group, or a nitro group; W represents a hydrophobic residue having 8 to 32 carbon atoms; V represents a hydrogen atom or a group selected from the groups represented by X and W, in which said group for V may be the same as or different from the group of X or W; Y represents an aryl group or a heterocyclic group; and Z represents a hydrogen atom or a group capable of being released by the coupling reaction with an oxidation product of an aromatic primary amine color developing agent.

3. The color photographic material of claim 2, in which Z is a hydrogen atom.

4. The color photographic material of claim 2, in which Z is an arylazo group or a heterocyclic azo group.

5. The color photographic material of claim 2, in which Z is a group capable of being released by the coupling reaction with an oxidation product of an aromatic primary amine color developing agent.

6. The color photographic material of claim 2, in which Z is an arylthio group containing at least 12 carbon atoms.

7. The color photographic material of claim 2, in which Y is a phenyl group in which at least one of the ortho-positions is substituted with a halogen atom, an alkyl group, an alkoxyl group, an aryloxy group, a cyano group, a nitro group, an acylamino group, or a carboxyl group.

8. The color photographic material of claim 2, in which Y is a moiety represented by the general formula

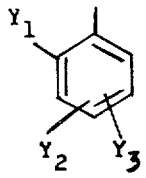

wherein $Y_1$ represents a halogen atom, an alkyl group, an alkoxyl group, an aryloxy group, a nitro group, a cyano group, an acylamino group, or a carboxyl group and $Y_2$ and $Y_3$ each represents a hydrogen atom, a halogen atom, an alkyl group, an aryloxy group, a nitro group, a cyano group, an acylamino group, or a carboxyl group.

9. The color photographic material of claim 2, in which V is a hydrogen atom and W is a group having a hydrophobic residue of 8 to 32 carbon atoms.

10. The color photographic material of claim 2 in which V is a hydrogen atom and W is a carbonamide group, a carbonimide group, a carbomoyl group, a sulfonamide group, a sulfamoyl group an alkoxycarbonyl group, a ureido group, a sulfonyl group, a carbonyl group, an alkoxyl group, an amino group, an imide group, or a thioether group, said group having a hydrophobic residue of 8 to 32 carbon atoms.

11. The color photographic material of claim 1, in which said hydroquinone compound is a compound represented by the general formula (II)

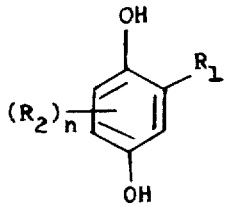

(II)

wherein $R_1$ and $R_2$, which may be the same or different, each represents an alkyl group, an aryl group, an alkoxyl group, an aryloxy group, an aralkyl group, a carbomoyl group, a carbamoylalkyl group, an alkyloxy group, a carbonylalkyl group, or a halogen atom, in which $R_2$ may additionally be a hydrogen atom and the sum of the number of carbon atoms of said $R_1$ and $R_2$ being at least 8, and n is 1, 2, or 3.

12. The color photographic material of claim 11, in which $R_1$ is a straight chain or branched chain alkyl group and $R_2$ is a hydrogen atom or a straight chain or branched chain alkyl group, with the sum of the carbon atoms of said $R_1$ and $R_2$ being 8 to 32.

13. The color photographic material of claim 1, in which said hydroquinone compound is present in said silver halide emulsion layer containing said 3-anilino-5-pyrazolone type magenta dye forming coupler.

14. The color photographic material of claim 1, in which said photographic material comprises a support having thereon at least a green-sensitive silver halide emulsion layer, a differently sensitized silver halide emulsion layer, an a hydrophilic colloid layer present between said two silver halide emulsion layers, said green-sensitive silver halide emulsion layer containing said 3-anilino-5-pyrazolone type magenta dye forming coupler and said hydrophilic colloid layer containing said hydroquinone compound.

15. The color photographic material of claim 1, in which the ortho position of the anilino group at the 3-position of said pyrazolone ring is substituted with a halogen atom.

16. The color photographic material of claim 1, in which the ortho position of the anilino group at the 3-position of said pyrazolone ring is substituted with a chlorine atom.

17. The color photographic material of claim 1, in which the ortho position of the anilino group at the 3-position of said pyrazolone ring is substituted with an alkoxy group.

18. The color photographic material of claim 2, wherein Z is said group capable of being released by the coupling reaction with an oxidation product of an aromatic primary amine color developing agent, and Z is selected from the group consisting of a thiamino group, an acyloxy group, an aryloxy group, an aralkyloxycarbonyloxy group, an alkyloxycarbonyloxy group, a halogen atom, an arylazo group, a 2-aryltriazolyl group, an alkylthio group, an arylthio group, a heterothio group, a cycloalkylthio group, and a cycloalkoxyl group.

* * * * *